US008293036B2

(12) United States Patent
Branagan et al.

(10) Patent No.: US 8,293,036 B2
(45) Date of Patent: Oct. 23, 2012

(54) EXPLOITATION OF DEFORMATION MECHANISMS FOR INDUSTRIAL USAGE IN THIN PRODUCT FORMS

(75) Inventors: Daniel James Branagan, Idaho Falls, ID (US); Brian E. Meacham, Idaho Falls, ID (US); Jikou Zhou, Pleasanton, CA (US); Alla V. Sergueeva, Idaho Falls, ID (US)

(73) Assignee: The NanoSteel Company, Inc., Providence, RI (US)

( * ) Notice: Subject to any disclaimer, the term of this patent is extended or adjusted under 35 U.S.C. 154(b) by 85 days.

(21) Appl. No.: 12/612,319

(22) Filed: Nov. 4, 2009

(65) Prior Publication Data

US 2010/0111747 A1 May 6, 2010

Related U.S. Application Data

(60) Provisional application No. 61/111,124, filed on Nov. 4, 2008.

(51) Int. Cl.
*C22C 45/10* (2006.01)

(52) U.S. Cl. ..... 148/561; 148/304; 148/403

(58) Field of Classification Search ..... 148/561, 148/403, 304

See application file for complete search history.

(56) References Cited

U.S. PATENT DOCUMENTS

| | | | | |
|---|---|---|---|---|
| 1,793,529 | A | | 2/1931 | Taylor |
| 3,600,360 | A | | 8/1971 | Kwolek |
| 3,671,542 | A | | 6/1972 | Kwolek |
| 3,767,756 | A | | 10/1973 | Blades |
| 3,817,941 | A | | 6/1974 | Blades |
| 3,819,587 | A | | 6/1974 | Kwoleck |
| 4,052,201 | A | * | 10/1977 | Polk et al. ..... 148/403 |
| 4,114,058 | A | * | 9/1978 | Albaric ..... 310/54 |
| 4,576,653 | A | | 3/1986 | Ray |
| 4,806,179 | A | | 2/1989 | Hagiwara et al. |
| 2005/0252586 | A1 | | 11/2005 | Branagan |
| 2008/0268288 | A1 | | 10/2008 | Jin et al. |

OTHER PUBLICATIONS

International Search Report and Written Opinion dated Dec. 30, 2009 issued in related International Patent Application No. PCT/U509/63251.

ASTM E 2456-06, Standard Terminology Relating to Nanotechnology, 2007.

Gleiter, "Nanocrystalline Materials," Prog. Mater. Sci. 33 (1989), 223-315.

Dao, "Toward a quantitative understanding of mechanical behavior of nanocrystalline metals," Acta Materialia 55 (2007), 4041-4065.

(Continued)

*Primary Examiner* — Sikyin Ip

(74) *Attorney, Agent, or Firm* — Grossman, Tucker, Perreault & Pfleger, PLLC

(57) ABSTRACT

The present disclosure relates to a glass forming alloy. The glass forming alloy may include 43.0 atomic percent to 68.0 atomic percent iron, 10.0 atomic percent to 19.0 atomic percent boron, 13.0 atomic percent to 17.0 atomic percent nickel, 2.5 atomic percent to 21.0 atomic percent cobalt, optionally 0.1 atomic percent to 6.0 atomic percent carbon, and optionally 0.3 atomic percent to 3.5 atomic percent silicon. Furthermore, the glass forming alloy includes between 5% to 95% by volume one or more spinodal glass matrix microconstituents which include one or more semi-crystalline or crystalline phases at a length scale less than 50 nm in a glass matrix. In addition, the glass forming alloy is capable of blunting shear bands through localized deformation induced changes under tension.

7 Claims, 20 Drawing Sheets

OTHER PUBLICATIONS

Klement, "Non-crystalline Structure in Solidified Gold-Silicon Alloys," Nature 187 (1960), 869-870.

Johnson, "Bulk Glass-Forming Metallic Alloys: Science and Technology," MRS Bull. 24 (1999), 42-56.

Inoue, "Stabilization of Metallic Supercooled Liquid and Bulk Amorphous Alloys," Acta mater. 48 (2000) 279-306.

Greer, "Bulk Metallic Glasses: At the Cutting Edge of Metals Research," MRS Bulletin 32 (2007), 611.

Jia, "Effects of Nanocrystalline and Ultrafine Grain Sizes on Constitutive Behavior and Shear Bands in Iron," Acta Mater. 51 (2003), 3495-3509.

Flores, "Mean Stress Effects on Flow Localization and Failure in a Bulk Metallic Glass," Acta mater. 49 (2001) 2527-2537.

Zhao,"Simultaneously Increasing the Ductility and Strength of Nanostructured Alloys," Adv. Mater. 18 (2006), 2280 2283.

Steif, "Strain Localization in Amorphous Metals," Acta Metall. 30 (1982), 447-455.

Zhang, "Modulated oscillatory hardening and dynamic recrystallization in cryomilled nanocrystalline Zn," Acta Mater. 50 (2002), 3995-4004.

Chen, Deformation-induced nanocrystal formation in shear bands of amorphous alloys Nature 367 (1994), 541-543.

Hays, "Microstructure Controlled Shear Band Pattern Formation and Enhanced Plasticity of Bulk Metallic Glasses Containing in situ Formed Ductile Phase Dendrite Dispersions," Phys. Rev. Lett. 84 (2000), 2901-2904.

Yim, "Bulk metallic glass matrix composites," Appl. Phys. Lett. 71 (1997), 3808-3810.

Szuecs, "Mechanical Properties of Zr56.2 Ti13.8 Nb5.0 Cu6.9 Ni5.6 Be12.5 Ductile Phase Reinforced Bulk Metallic Glass Composite," Acta Mater. 49 (2001) 1507-1513.

Yavari, "FeNiB-based metallic glasses with fcc crystallisation products," Journal of Non-Crystalline Solids 304 (2002) 44-50.

Fan,"Metallic glass matrix composite with precipitated ductile reinforcement," Appl. Phys. Lett. 81 (2002) 1020-1022.

He, "Novel Ti-base nanostructure-dendrite composite with enhanced plasticity," Nature Mater. 2 (2003) 33-37.

Lee, "Effect of a controlled volume fraction of dendritic phases on tensile and compressive ductility in La-based metallic glass matrix composites," Acta Materia1ia 52 (2004) 4121-4131.

Eckert, "Strengthening of multicomponent glass-forming alloys by microstructure design," Journal of Non-Crystalline Solids 353 (2007) 3742-3749.

Qin,"Mechanical properties and corrosion behavior of (Cu0.6Hf0.25Ti0.15)90Nb10 bulk metallic glass composites," Materials Science and Engineering A449-451 (2007) 230-234.

Lee, "Reappraisal of the work hardening behavior of bulk amorphous matrix composites," Materials Science and Engineering A513-514 (2009) 160-165.

Fan, "Ductility of bulk nanocrystalline composites and metallic glasses at room temperature,"Appl. Phys. Lett. 77 (2000) 46-48.

Kim, "Role of nanometer-scale quasicrystals in improving the mechanical behavior of Ti-based bulk metallic glasses," Appl. Phys. Lett. 83 (2003) 3093-3095.

Das, "'Work-Hardenable' Ductile Bulk Metallic Glass," Phys. Rev. Lett. 94 (2005) 205501 (4 Pages).

Hajilaoui, "Ductilization of BMGs by optimization of nanoparticle dispersion," Journal of Alloys and Compounds 434-435 (2007) 6-9.

Kim, "Heterogeneity of a CU47.5Zr47.5AI5 bulk metallic glass" Applied Physics Letters 88,051911 (2006) (3 Pages).

Yao, "Superductile bulk metallic glass," Applied Physics Letters 88, 122106 (2006) (3 Pages).

Kim, "Work hardening ability of ductile Ti45Cu40Ni7.5Zr5Sn2.5 and CU47.5Zr47.5AI5 bulk metallic glasses," Applied Physics Letters 89, 071908 (2006) (3 Pages).

Lee, "Extraordinary plasticity of an amorphous alloy based on atomistic-scale phase separation," Materials Science and Engineering A 485 (2008) 61-65.

Chen, "Free-volume-induced enhancement of plasticity in a monolithic bulk metallic glass at room temperature," Scripta Materialia 59 (2008) 75-78.

Hofmann, "Designing metallic glass matrix composites with high toughness and tensile ductility," Nature 451 (2008) 1085 (6 pages).

Lee, "Deformation behavior of strip-cast bulk amorphous matrix composites containing various crystalline particles," Materials Science and Engineering A 449-451 (2007) 176-180.

Meyers, et al., "Mechanical properties of nanocrystalline materials," Progress in Materials Science, 51 (2006) 427-556.

Kato, et al. "Synthesis and Mechanical Properties of Bulk Amorphous Zr-Al-Ni-Cu Alloys Containing ZrC Particles," Mater. Trans. JIM vol. 38 No. 09 (1997) p. 793.

Taylor, "A method of drawing metallic filaments and a discussion of their properties and uses," Phys. Rev., 23, (1924) pp. 655-660.

Larin, et al., "Preparation and properties of glass-coated microwires", J. Magn. Magn. Mat., 249 (2002), 39-45.

Donald et al., "The preparation, properties and applications of some glass-coated metal filaments prepared by the Taylor-wire process", J. Material Science, 33(1996), 1139-1149.

Chiriac, "Preparation and characterization of glass covered magnetic wires", Material Science and Engineering, A304-306(2001), 166-171.

Decristofaro, "Amorphous Metals in Electric-Power Distribution Applications", MRS Bulletin, vol. 23, No. 5, 1198, 50-56.

* cited by examiner

Para Meta

EXPLOITATION OF DEFORMATION MECHANISMS FOR INDUSTRIAL USAGE IN THIN PRODUCT FORMS

CROSS-REFERENCE TO RELATED APPLICATIONS

The present application claims the benefit of the filing date of U.S. Provisional Patent Application Ser. No. 61/111,124, filed on Nov. 4, 2008, which is fully incorporated herein by reference.

FIELD OF INVENTION

The present application relates to mechanisms for plasticity at room temperature which may arise from spinodal glass matrix microconstituent structures in a glass forming matrix. The resulting alloys may be formed in relatively thin product forms such as fiber, ribbon, wire, and thin sheet (i.e. foil) and may be utilized for a wide variety of industrial usages.

BACKGROUND

Metals are understood to exhibit primarily nondirectional metallic bonds, which allow bonds to break under the application of a stress/load and then reform allowing metals the ability to have intrinsic ductility and the ability to deform plastically. Mechanistically, metals may deform at room temperature primarily through the movement of dislocations. Dislocations may be understood as one-dimensional type defects which can exhibit edge, screw, or mixed character and move by breaking the bonds of individual atoms one at a time resulting in a displacement of the atoms by one Burgers vector. Dislocations are found to move on their slip systems, which depending on the specific crystal structure and space group, may involve specific planes and specific crystallographic directions.

It may be appreciated that in ionically bonded ceramic materials, dislocations can also play a role in deformation. However, these classes of materials have bonds which may be directional and involve transfer of electrons and the formation of specific ions. Thus, after a particular bond is broken, this places positive ions next to positive ions or negative ions next to negative ions and the repulsion forces make it difficult to reform the bonds. Thus, due to the high strength of the ceramic bonds, ceramic materials can exhibit a relatively high hardness and strength which often are superior to that found in metals. However, ceramic materials may generally be brittle with an inherent inability to deform plastically.

Nanocrystalline metallic materials may also offer relatively high strength and hardness. Nanocrystalline materials may be understood to be, by definition, polycrystalline structures with a mean grain size below 100 nm. They have been the subject of widespread research since the mid-1980s when it was argued that metals and alloys, if made nanocrystalline, would have a number of appealing mechanical characteristics of potential significance for structural applications. But despite relatively attractive properties (high hardness, yield stress and fracture strength), it is well known that nanocrystalline materials may generally show a disappointing and very low tensile elongation and tend to fail in an extremely brittle manner. In fact, the decrease of ductility for decreasing grain sizes has been known for a long time as attested, for instance, by the empirical correlation between the work hardening exponent and the grain size as proposed for cold rolled and conventionally recrystallized mild steels. As the grain size is progressively decreased, the formation of dislocation pileups may become more difficult and their movement is quite limited by the large amount of 2-d defect phase and grain boundaries. Thus, with the development of nanocrystalline grains, the achievement of adequate ductility (>1%) has been a challenge.

Metallic glasses are a class of materials which may exhibit characteristics which are both metallic like since they contain non-directional metallic bonds, metallic luster, and significant electrical and thermal conductivity, and ceramic like since relatively high hardness is often obtained coupled with brittleness and the lack of tensile ductility. Amorphous metallic alloys (i.e., metallic glasses) represent a relatively young class of materials, having been first reported in 1960 when classic rapid-quenched experiments were performed on Au—Si alloys. Since that time, there has been remarkable progress in exploring glass forming alloy compositions, seeking elemental combinations with ever-lower critical cooling rates for the retention of an amorphous structure. Metallic glasses are understood to be supercooled liquids which may exist in solid form at room temperature but have structures which are relatively similar to what is found in the liquid with relatively short range order present. Metallic glasses may have free electrons, exhibit metallic luster, and exhibit metallic bonding similar to what is found in conventional metals. All metallic glasses may be considered metastable materials and when heated up, they will transform into crystalline state. The process is called crystallization or devitrification. Since diffusion is limited at room temperature, enough heat (i.e. Boltzman's Energy) needs to be applied to overcome the nucleation barrier to cause a solid-solid state transformation which is caused by glass devitrification. The devitrification temperature of metallic glasses can vary widely, commonly from 300 to 800° C. with enthalpies of crystallization commonly from −25 to −250 J/g. The devitrification process can occur in one or multiple stages. When occurring in multiple stages, a crystalline phase may be formed and then depending on the specific partition coefficient, atoms may either be attracted to the new crystallites or rejected into the remaining volume of the glass. This may result in a more stable glass chemistry which may necessitate additional heat input to cause partial or full devitrification. Thus, partially devitrified structures can result in crystalline precipitates in a glass matrix. Commonly, these precipitates may be in the size range of 30 to 125 nm. Full devitrification to a completely crystalline state may result from heat treating above the highest temperature glass peak which can be revealed through thermal analysis such as differential scanning calorimetry or differential thermal analysis.

Due to the extremely fine length scale of the structural order (i.e. molecular associations) and near defect free nature of the material (i.e. no 1-d dislocation or 2-d grain/phase boundary defects), relatively high strength (and correspondingly hardness) may be obtained which can be on the order of 33 to 45% of theoretical. However, due to the lack of crystallinity, dislocations may not be found and so far there is does not appear to be a mechanism for significant (i.e. >2%) tensile elongation. Metallic glasses may exhibit relatively limited fracture toughness associated with the rapid propagation of shear bands and/or cracks which may be a concern for the technological utilization of these materials. While these materials may show adequate ductility by testing in compression, when testing in tension they may exhibit elongations very close to zero and fracture in the brittle manner. The inherent inability of these classes of material to be able to deform in tension at room temperature may be a relatively limiting factor for potential structural applications where intrinsic ductility may be needed to avoid catastrophic failure.

Owing to strain softening and/or thermal softening, plastic deformation of metallic glasses may be relatively highly localized into shear bands, resulting in a relatively limited plastic strain (less than 2%) and catastrophic failure at room temperature. Different approaches have been applied to enhanced ductility of metallic glasses including: introducing heterogeneities such as micrometer-sized crystallites, nanometer-sized crystallites, glassy phase separation, or by introducing free volume in amorphous structure. The heterogeneous structure of these composites may act as an initiation site for the formation of shear bands and/or a barrier to the rapid propagation of shear bands, which may result in enhancement of global plasticity in compression and sometimes a corresponding decrease in the strength. Recently, a number of metallic glasses have been fabricated in which the plasticity was attributed to stress-induced nanocrystallization or a relatively high Poisson ratio. It should be noted, that with these approaches, metallic glasses may exhibit enhanced plasticity during compression tests (12-15%) but their tensile elongation may not exceed 2%. Very recent results on improvement of tensile ductility of metallic glasses was published when 13% tensile elongation was achieved in a zirconium based alloys with large dendrites (20-50 μm in size) embedded in glassy matrix. It should be noted that this material is primarily crystalline and might be considered as a microcrystalline alloy with residual amorphous phase along dendrite boundaries. The maximum strength of these alloys as reported is 1.5 GPa. Thus, while metallic glasses are known to exhibit favorable characteristics of relatively high strength and high elastic limit, their ability to deform in tension may be extremely limited which severely limits the industrial utilization of this class of materials.

SUMMARY

In one aspect, the present disclosure relates to a glass forming alloy. The glass forming alloy may include 43.0 atomic percent to 68.0 atomic percent iron, 10.0 atomic percent to 19.0 atomic percent boron, 13.0 atomic percent to 17.0 atomic percent nickel, 2.5 atomic percent to 21.0 atomic percent cobalt, optionally 0.1 atomic percent to 6.0 atomic percent carbon, and optionally 0.3 atomic percent to 3.5 atomic percent silicon. The glass forming alloy may include between 5% to 95% by volume one or more spinodal glass matrix microconstituents which may include one or more semi-crystalline and/or crystalline phases at a length scale less than 50 nm in a glass matrix. Furthermore, the alloy may be capable of blunting shear bands through localized deformation induced changes under tension.

In another aspect, the present disclosure relates to a method of forming spinodal microconstituents in a glass forming alloy. The method may include melting alloy constituents including 43.0 atomic percent to 68.0 atomic percent iron, 10.0 atomic percent to 19.0 atomic percent boron, 13.0 atomic percent to 17.0 atomic percent nickel, 2.5 atomic percent to 21.0 atomic percent cobalt, optionally 0.1 atomic percent to 6.0 atomic percent carbon, and optionally 0.3 atomic percent to 3.5 atomic percent silicon to form an alloy, and forming and cooling the alloy wherein upon cooling the glass forming alloy includes between 5% to 95% by volume one or more spinodal microconstituents comprising one or more semi-crystalline and/or crystalline phases at a length scale less than 50 nm in a glass matrix capable of blunting shear bands through localized deformation induced changes under tension.

BRIEF DESCRIPTION OF DRAWINGS

The above-mentioned and other features of this disclosure, and the manner of attaining them, will become more apparent and better understood by reference to the following description of embodiments described herein taken in conjunction with the accompanying drawings, wherein:

FIG. 5*a*) illustrates alloy PC7e8 melt-spun at 10 m/s showing Type 1 Behavior, FIG. 5*b*) illustrates alloy PC7e8S1A7 melt-spun at 10.5 m/s showing Type 2 Behavior, FIG. 5*c*) illustrates alloy PC7e8S1A14 melt-spun at 10.5 m/s showing Type 3 Behavior, and FIG. 5*d*) illustrates alloy PC7e8S1A9 melt-spun at 10 m/s exhibiting Type 4 Behavior.

FIG. 20*a*) illustrates the edge crack is arrested, FIG. 20*b*) illustrates the crack deflecting and macroscale branching, FIG. 20*c*) illustrates crack deflecting and microscale branching.

FIG. 21*a*) illustrates a crack arrested at a very initial growing stage, and FIG. 21*b*) illustrates a crack deflecting and branching at a sub-micron scale.

DETAILED DESCRIPTION

Figure 1:
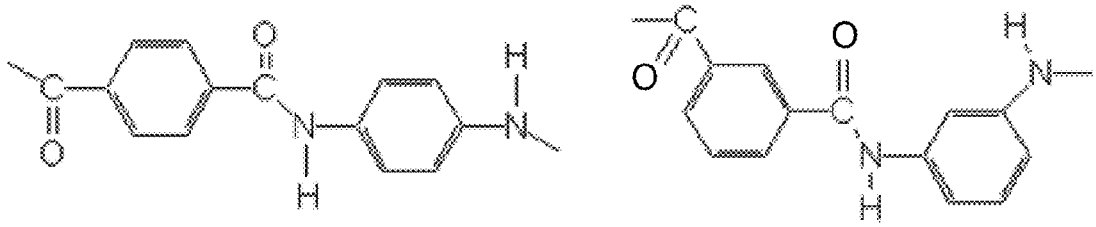
FIG. 1 illustrates the chemical structure of para-aramid and meta-aramid polymers.

The present application relates to glass forming chemistries which may lead to Spinodal Glass Matrix Microconstituent (SGMM) structures which may exhibit relatively significant ductility and high tensile strength. Spinodal microconstituents may be understood as microconstituents formed by a transformation mechanism which is not nucleation controlled. More basically, spinodal decomposition may be understood as a mechanism by which a solution of two or more components (e.g. metal compositions) of the alloy can separate into distinct regions (or phases) with distinctly different chemical compositions and physical properties. This mechanism differs from classical nucleation in that phase separation occurs uniformly throughout the material and not just at discrete nucleation sites. One or more semicrystalline clusters or crystalline phases may therefore form through a successive diffusion of atoms on a local level until the chemistry fluctuations lead to at least one distinct crystalline phase. Semi-crystalline clusters may be understood herein as exhibiting a largest linear dimension of 2 nm or less, whereas crystalline clusters may exhibit a largest linear dimension of greater than 2 nm. Note that during the early stages of the spinodal decomposition, the clusters which are formed may be relatively small and while their chemistry differs from the glass matrix, they are not yet fully crystalline and have not yet achieved well ordered crystalline periodicity. Additional crystalline phases may exhibit the same crystal structure or distinct structures. Furthermore the glass matrix may be understood to include microstructures that may exhibit associations of structural units in the solid phase that may be randomly packed together. The level of refinement, or the size, of the structural units may be in the angstrom scale range (i.e. 5 Å to 100 Å).

In addition, the alloys may exhibit Induced Shear Band Blunting (ISBB) and Induced Shear Band Arresting (ISBA) which may be enabled by the spinodal glass matrix microconstituent (SGMM). While conventional materials deform through dislocations moving on specific slip systems in crystalline metals, the mechanism may involve moving shear bands (i.e., discontinuities where localized deformation occurs) in a spinodal glass matrix microconstituent which are blunted by localized deformation induced changes (LDIC) described further herein. With increasing levels of stress, once a shear band is blunted, new shear bands may be nucleated and then interact with existing shear bands creating relatively high shear band densities in tension and the development of relatively significant levels of global plasticity. Thus, the alloys with favorable SGMM structures may prevent or mitigate shear band propagation in tension, which may result in relatively significant tensile ductility (>1%) and lead to strain hardening during tensile testing.

The alloys contemplated herein may include or consist of chemistries capable of forming a spinodal glass matrix microconstituent, wherein the spinodal glass matrix microconstituents may be present in the range of 5 to 95% by volume. In some examples, the alloys may include iron present in the range of 43.0 to 68.0 atomic percent (at. %), boron present in the range of 10.0 to 19.0 at. %, carbon optionally present in the range of 0.1 to 6.0 at. %, silicon optionally present in the range of 0.3 to 3.5 at. %, nickel present in the range of 13.0 to 17.0 at. %, and cobalt present in the range of 2.5 to 21.0 at. %. In addition, the alloys may include one or more of titanium present in the range of 1.0 to 8.0 at %, molybdenum present in the range of 1.0 to 8.0 at %, copper present in the range of 1.0 to 8.0 at %, cerium present in the range of 1.0 to 8.0 at % and aluminum present in the range of 2.0 to 16.0 at %. In one embodiment, the alloy may include iron present in the range of 43.0 to 68.0 atomic percent (at. %), boron present in the range of 12.0 to 19.0 at. %, carbon optionally present in the range of 0.1 to 6.0 at. %, silicon optionally present in the range of 0.40 to 3.50 at. %, nickel present in the range of 15.0 to 17.0 at. %, cobalt present in the range of 2.5 to 21.0 at. %. In another embodiment, the alloy may include iron present in the range of 52.0 to 63.0 atomic percent (at. %), boron present in the range of 10.0 to 13.0 at. %, carbon present in the range of 3.5 to 5.0 at. %, silicon present in the range of 0.3 to 0.5 at. %, nickel present in the range of 13.0 to 17.0 at. %, cobalt present in the range of 2.5 to 3.0 at. % and optionally, one or more of titanium present in the range of 1.0 to 8.0 at %, molybdenum present in the range of 1.0 to 8.0 at %, copper present in the range of 1.0 to 8.0 at %, cerium present in the range of 1.0 to 8.0 at % and aluminum present in the range of 2.0 to 16.0 at %.

Accordingly, it may be appreciated that the above elemental constituents may be present at a total of 100 at. %. In addition, it may be appreciated that impurities may be present up to 5 at. %, including any value in the range of greater than 0 at. % to 5 at. %. Furthermore, it may be appreciated that the above elemental constituent may be present at any value or increments in the ranges cited herein. For example iron may be present at 43.0, 43.1, 43.2, 43.3, 43.4, 43.5, 43.6, 43.7, 43.8, 43.9, 44.0, 44.1, 44.2, 44.3, 44.4, 44.5, 44.6, 44.7, 44.8, 44.9, 45.0, 45.1, 45.2, 45.3, 45.4, 45.5, 45.6, 45.7, 45.8, 45.9, 46.0, 46.1, 46.2, 46.3, 46.4, 46.5, 46.6, 46.7, 46.8, 46.9, 47.0, 47.1, 47.2, 47.3, 47.4, 47.5, 47.6, 47.7, 47.8, 47.9, 48.0, 48.1, 48.2, 48.3, 48.4, 48.5, 48.6, 48.7, 48.8, 48.9, 49.0, 49.1, 49.2, 49.3, 49.4, 49.5, 49.6, 49.7, 49.8, 49.9, 50.0, 50.1, 50.2, 50.3, 50.4, 50.5, 50.6, 50.7, 50.8, 50.9, 51.0, 51.1, 51.2, 51.3, 51.4, 51.5, 51.6, 51.7, 51.8, 51.9, 52.0, 52.1, 52.2, 52.3, 52.4, 52.5, 52.6, 52.7, 52.8, 52.9, 53.0, 53.1, 53.2, 53.3, 53.4, 53.5, 53.6, 53.7, 53.8, 53.9, 54.0, 54.1, 54.2, 54.3, 54.4, 54.5, 54.6, 54.7, 54.8, 54.9, 55.0, 55.1, 55.2, 55.3, 55.4, 55.5, 55.6, 55.7, 55.8, 55.9, 56.0, 56.1, 56.2, 56.3, 56.4, 56.5, 56.6, 56.7, 56.8, 56.9, 57.0, 57.1, 57.2, 57.3, 57.4, 57.5, 57.6, 57.7, 57.8, 57.9, 58.0, 58.1, 58.2, 58.3, 58.4, 58.5, 58.6, 58.7, 58.8, 58.9, 59.0, 59.1, 59.2, 59.3, 59.4, 59.5, 59.6, 59.7, 59.8, 59.9, 60.0, 60.1, 60.2, 60.3, 60.4, 60.5, 60.6, 60.7, 60.8, 60.9, 61.0, 61.1, 61.2, 61.3, 61.4, 61.5, 61.6, 61.7, 61.8, 61.9, 62.0, 62.1, 62.2, 62.3, 62.4, 62.5, 62.6, 62.7, 62.8, 62.9, 63.0, 63.1, 63.2, 63.3, 63.4, 63.5, 63.6, 63.7, 63.8, 63.9, 64.0, 64.1, 64.2, 64.3, 64.4, 64.5, 64.6, 64.7, 64.8, 64.9, 65.0, 65.1, 65.2, 65.3, 65.4, 65.5, 65.6, 65.7, 65.8, 65.9, 66.0, 66.1, 66.2, 66.3, 66.4, 66.5, 66.6, 66.7, 66.8, 66.9, 67.0, 67.1, 67.2, 67.3, 67.4, 67.5, 67.6, 67.7, 67.8, 67.9, and/or 68.0 at. %. Boron may be present at 10.0, 10.1, 10.2, 10.3, 10.4, 10.5, 10.6, 10.7, 10.8, 10.9, 11.0, 11.1, 11.2, 11.3, 11.4, 11.5, 11.6, 11.7, 11.8, 11.9, 12.0, 12.1, 12.2, 12.3, 12.4, 12.5, 12.6, 12.7, 12.8, 12.9, 13.0, 13.1, 13.2, 13.3, 13.4, 13.5, 13.6, 13.7, 13.8, 13.9, 14.0, 14.1, 14.2, 14.3, 14.4, 14.5, 14.6, 14.7, 14.8, 14.9, 15.0, 15.1, 15.2, 15.3, 15.4, 15.5, 15.6, 15.7, 15.8, 15.9, 16.0, 16.1, 16.2, 16.3, 16.4, 16.5, 16.6, 16.7, 16.8, 16.9, 17.0, 17.1, 17.2, 17.3, 17.4, 17.5, 17.6, 17.7, 17.8, 17.9, 18.0, 18.1, 18.2, 18.3, 18.4, 18.5, 18.6, 18.7, 18.8, 18.9, and/or 19.0 at. %. Carbon may be present at 0, 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, and/or 6.0 at. %. Silicon may be present at 0, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, and/or 3.5 at. %. Nickel may be present at 13.0, 13.1, 13.2, 13.3, 13.4, 13.5, 13.6, 13.7, 13.8, 13.9, 14.0, 14.1, 14.2, 14.3, 14.4, 14.5, 14.6, 14.7, 14.8, 14.9, 15.0, 15.1, 15.2, 15.3, 15.4, 15.5, 15.6, 15.7, 15.8, 15.9, 16.0, 16.1, 16.2, 16.3, 16.4, 16.5, 16.6, 16.7, 16.8, 16.9, and/or 17 at. %. Cobalt may be present at 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0, 9.1, 9.2, 9.3, 9.4, 9.5, 9.6, 9.7, 9.8, 9.9, 10.0, 10.1, 10.2, 10.3, 10.4, 10.5, 10.6, 10.7, 10.8, 10.9, 11.0, 11.1, 11.2, 11.3, 11.4, 11.5, 11.6, 11.7, 11.8, 11.9, 12.0, 12.1, 12.2, 12.3, 12.4, 12.5, 12.6, 12.7, 12.8, 12.9, 13.0, 13.1, 13.2, 13.3, 13.4, 13.5, 13.6, 13.7, 13.8, 13.9, 14.0, 14.1, 14.2, 14.3, 14.4, 14.5, 14.6, 14.7, 14.8, 14.9, 15.0, 15.1, 15.2, 15.3, 15.4, 15.5, 15.6, 15.7, 15.8, 15.9, 16.0, 16.1, 16.2, 16.3, 16.4, 16.5, 16.6, 16.7, 16.8, 16.9, 17.0, 17.1, 17.2, 17.3, 17.4, 17.5, 17.6, 17.7, 17.8, 17.9, 18.0, 18.1, 18.2, 18.3, 18.4, 18.5, 18.6, 18.7, 18.8, 18.9, 19.0, 19.1, 19.2, 19.3, 19.4, 19.5, 19.6, 19.7, 19.8, 19.9, 20.0, 20.1, 20.2, 20.3, 20.4, 20.5, 20.6, 20.7, 20.8, 20.9, and/or 21.0 at. %. Titanium may be present at 0.0, 1.0, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, and/or 8.0 at %. Molybdenum may be present at 0.0, 1.0, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, and/or 8.0 at %. Copper may be present at 0.0, 1.0, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, and/or 8.0 at %. Cerium may be present at 0.0, 1.0, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, and/or 8.0 at %. Aluminum may be present at 0.0, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0, 9.1, 9.2, 9.3, 9.4, 9.5, 9.6, 9.7, 9.8, 9.9, 10.0, 10.1, 10.2, 10.3, 10.4, 10.5, 10.6, 10.7, 10.8, 10.9, 11.0, 11.1, 11.2, 11.3, 11.4, 11.5, 11.6, 11.7, 11.8, 11.9, 12.0, 12.1, 12.2, 12.3, 12.4, 12.5, 12.6, 12.7, 12.8, 12.9, 13.0, 13.1, 13.2, 13.3, 13.4, 13.5, 13.6, 13.7, 13.8, 13.9, 14.0, 14.1, 14.2, 14.3, 14.4, 14.5, 14.6, 14.7, 14.8, 14.9, 15.0, 15.1, 15.2, 15.3, 15.4, 15.5, 15.6, 15.7, 15.8, 15.9, and/or 16.0 at %.

The alloys may also exhibit one or more crystallization peaks as measured by DTA. Initial peak onset crystallization temperatures may be in the range of 350° C. to 560° C., including all values and increments therein and peak crystallization temperatures may be in the range of 400 to 570° C., including all values and increments therein. Additional peak onset crystallization temperatures may be exhibited in the range of 425 to 630° C., including all values and increments therein and peak crystallization temperatures may be in the range of 440 to 640° C., including all values and increments therein.

The alloys may exhibit a tensile elongation greater than 1%, including greater than 2%. For example, the alloys may exhibit a tensile elongation of greater than 1% and up to 7%, including all values and increments in the range therein, such as 5% to 6%, etc. The alloys may also exhibit a tensile strength (ultimate tensile strength) of greater than 0.5 GPa, including all values and increments in the range of 0.5 GPa and 4 GPa. In addition, the alloys may exhibit a yield strength in the range of 0.3 GPa to 2.0 GPa, including all values and increments therein. Further, the alloys may exhibit a Young's modulus in the range of 70 GPa to 190 GPa, including all values and increments therein. In addition, the alloy may exhibit material densities from 6.5 to 8.5 g/cm$^3$. It may be appreciated that the alloys may exhibit one or more of the above properties in combination, including all of the above properties.

The alloys may include a glass forming chemistry exhibiting a critical cooling rate for metallic glass formation of about <100,000 K/s including all values and increments therein. In some examples, the alloys may be solidified at a cooling rate from ~$10^2$ to ~$10^6$ K/s. The resulting structure may include or consist primarily of metallic glass. In some examples, the resulting structure may include or consist of metallic glass and crystalline phases less than 500 nm in size. In addition, the alloys may transform to yield at least a portion of its structure a spinodal microconstituent, which may include or consists of one or more crystalline phases at a length scale less than 50 nm in a glass matrix.

The alloys may also be processed into relatively thin product forms including sheet, thin film, flake, foil, ribbon, fiber, powder, and wire. The alloys may be processed by various commercial and research scale production methods including Taylor-Ulitovsky wire making process and variations, chill block melt-spinning process and variations, planar flow casting process and variations, and twin roll casting, discussed further below. The product forms may be less than 2000 μm in thickness, including all values and increments in the range of 1 μm to 2000 μm and/or less than 2,000 μm in cross sectional diameter, including all values and increments in the range of 1 μm to 2,000 μm. For example, the product forms may be less than 250 μm in thickness or less than 250 μm in cross sectional diameter. In addition, the alloys may be used in relatively thin product forms including sheet, foil, ribbon, fiber, powder, and wire as stand alone products including weaves, structural reinforcement, fiber reinforcement, stand alone products, and structural products such as the pultrusion process.

Property Comparisons with Advanced Carbon Based Fibers:

The materials contemplated herein may be relatively different from existing high strength fibers, which may typically include organic molecules containing mainly carbon and hydrogen. One of the first well known organic fibers is nylon 6,6 which was developed by DuPont in 1935. High performance organic fibers have been developed from either aramid or polyethylene polymers and have been commercially available for decades. Aramid fibers, the first to be developed, demonstrated an improvement in fiber properties over other organic fibers. Aramid and polyethylene fiber properties have only recently been surpassed by carbon fibers that may commonly used in the aerospace industry but carbon fibers may typically be used for composite materials where the fiber or cloth may impregnated with an epoxy resin. The tensile strength of the aramid and polyethylene fibers may be relatively high and these fibers may generally be light weight because of their relatively low density. The properties of the different types of fibers may not be the same and aramid fibers may have improved thermal resistance due to their chemical structure while polyethylene fibers have improved abrasion resistance due to the low coefficient of friction. A detrimental property that both fibers may exhibit is that their mechanical, thermal and physical properties are relatively anisotropic in the longitudinal and transverse directions. The fibers may be bundled into strands at which point conventional textile techniques can combine strands into yarns that can then be woven into cloths with different weave patterns or twisted into chords, ropes and cables. These products have been used in rubber reinforcement for automobile tires, making fire proof clothing, manufacturing bullet proof vests and ropes or cables.

KEVLAR is an organic fiber made from poly-para-phenylene terephthalamide, a member of the aromatic polyamide polymer family, which is known more commonly as aramid. Aramid polymers may be divided into either para-aramid polymers or meta-aramid polymers with the difference demonstrated in FIG. 1. For common aramid fibers that are commercially available, KEVLAR®, TWARON®, TECHNORA®, ARMOS® and SVM® are para-aramid polymers while NOMEX® and TEIJINCONEX® are meta-aramid polymers. In a para-aramid polymer the amide groups may attach to the aromatic benzene ring at carbon atoms that are opposite one another while in a meta-aramid polymer the amide groups may be just attached at non-adjacent carbon atoms in the ring. The chemical structure of the polymer may affect the microstructure of the fiber, which may determine the fiber properties. Para-aramid polymers may tend to form straight molecules because of a linear backbone of benzene rings while meta-aramid polymers may tend to form bent or kinked molecules. A contributing factor to the formation of straight para-aramid molecules is the fact that the branching atoms oscillate from the left side to the right side along the benzene ring backbone.

Figure 2:
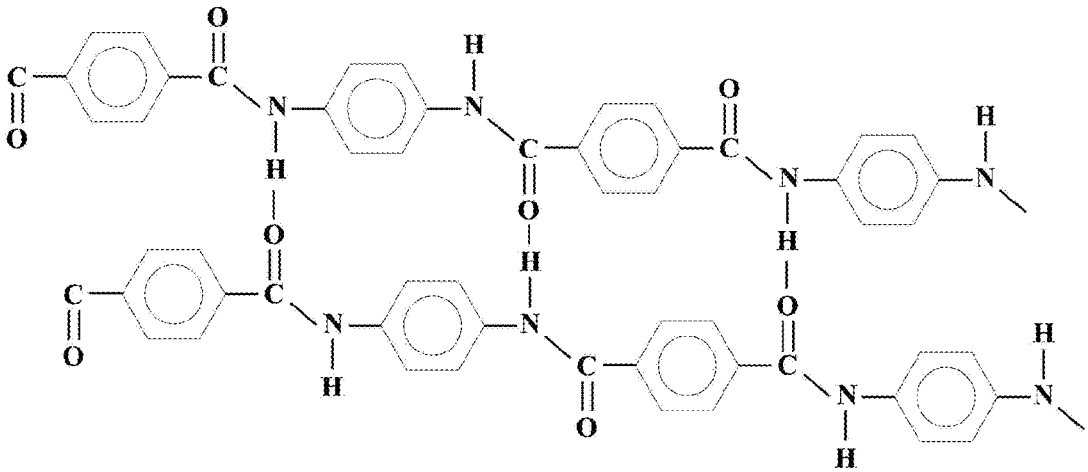
FIG. 2 illustrates two para-aramid molecules cross linked together by hydrogen bonding.

When KEVLAR fibers are manufactured the para-aramid molecules may undergo hydrogen bonding as depicted in FIG. 2. The hydrogen atoms associated with the nitrogen atoms in the backbone bond to the oxygen atoms that are covalently bound to backbone carbon atoms. KEVLAR has relatively high tensile strength in the fiber direction but relatively poor tensile strength perpendicular to the fiber direction. In the case of tension in the fiber direction, all of the same hydrogen bonds would have to be broken at the same time by the applied force along the molecular backbone, thus requiring a very large force in order to have the molecules come apart. However in the transverse direction such as when the fiber is bent, the hydrogen bonds can be broken one at a time, which does not require such a large force.

An example of the manufacturing process for the production of KEVLAR may include continuous dry jet wet spinning. The process may begin when poly-para-phenylene terephthalamide is dissolved into concentrated sulfuric acid resulting in the formation of a liquid crystalline solution consisting of rod like para-aramid molecules that may self align parallel to one another in the solution, which may exhibit a unique behavior when shear forces are applied. The solution may then be extruded and enacted upon by shear forces at an optimal elevated temperature through spinnerets forming continuous fibers that may then go into a cold water bath containing a dissolved base that neutralizes and removes any adsorbed acid. The extrusion, referred to as spinning in the textile industry, may be similar to the formation of nylon 6,6, initially causing the rod like molecules to rotate until they may align parallel due to the applied shear force. As the extrudate is extracted from the solution, the rods may come closer together where hydrogen bonding may cause them to become interconnected into a supramolecular structure that is the fiber.

KEVLAR fibers are known for their relatively high tensile strength and may be considered to be relatively resistant to fatigue or creep. KEVLAR has a relatively low thermal conductivity which means that KEVLAR products may have relatively high thermal resistance and may be flame resistant. While KEVLAR may eventually decompose by the oxidation of carbon at a sufficient temperature, fibers and cloths may stop burning when heat source is removed. The limitations of KEVLAR stem from its anisotropy with respect to mechanical, thermal and physical properties. Fibers can be damaged by bending, buckling or perpendicular loading and may be relatively weak in compression. The risk of decomposition by slow oxidation may limit the temperature range for reliable use to be below 150° C.-175° C. and mechanical properties may decrease with increasing temperature. Mechanical properties may also be sensitive to moisture content and may degrade with absorption of water though are recoverable when the moisture is extracted. Another limitation is that KEVLAR may not form strong bonds with other materials so it is not a good choice for composites. The fibers may also degrade if exposed to strong acid or base environments though they may be relatively better in basic environments than acidic environments. Finally, KEVLAR is susceptible to ultraviolet radiation where the mechanical properties may be reduced when exposed to ultraviolet radiation.

Figure 3:
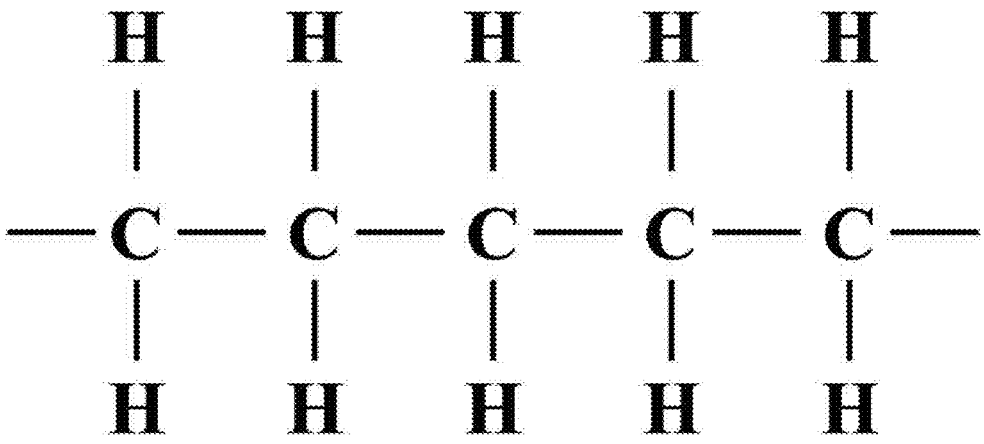
FIG. 3 illustrates an example of polyethylene molecular structure.

SPECTRA is an organic fiber made from polyethylene, an example of the structure of which is shown in FIG. 3, and available from Honeywell. Polyethylene is made up of long chains of ethylene molecules that are bound together. Polyethylene is one of the most common plastics that are produced commercially through out the world and is exemplified by the typical shopping bag found at grocery and convenience stores so it may be surprising that the same chemical can be manufactured into high performance organic fibers. Besides SPECTRA®, DYNEEMA® and TEKMILON® are also commercially available polyethylene fibers. Because the hydrogen in the polyethylene is tightly bound to the carbon chain there is no hydrogen bonding between molecules. Polyethylene fiber microstructure consists of polyethylene chains that are bound together by weak molecular van der Waals forces, which influence the resulting fiber properties.

SPECTRA may be manufactured by a process known as gel spinning. High molecular weight polyethylene may be dissolved into a volatile solvent forming a dilute isotropic solution. The solution may then be drawn through a spinneret and then may go into a cold water bath forming a gel precursor fiber. The solvent may be extracted from the precursor fiber upon which the fiber may then be hot drawn yielding the final fiber product. SPECTRA fibers can be produced at relatively lower cost than aramid fibers and may have relatively high tensile strength with relatively good vibrational damping characteristics. SPECTRA may exhibit a relatively low friction coefficient resulting in about ten times better abrasion resistance and better fatigue resistance than aramid fibers. Because its specific gravity is less than one, SPECTRA will float and exhibits relatively low moisture absorption so it may also be considered moisture resistant. It is relatively chemically inert, as exemplified by the fact that the molecules bond by van der Waals forces between the molecules, such that SPECTRA may be considered to exhibit better chemical resistance than aramid fibers.

The limitation for SPECTRA fibers also stem from its anisotropy with respect to mechanical, thermal and physical properties. Its relatively low melting point of 147° C. may limit the use to applications that are below 100° C. The transverse properties are worse because the molecules are only held together by the weak van der Waals forces, which may also be responsible for its poor creep resistance. It may burn continuously until consumed if ignited. Finally, it also may not bond well with other materials.

The spinodal glass matrix microconstituent (SGMM) iron based alloys may exhibit similar and, in some cases, relatively superior strength properties to the above mentioned polymeric materials. In Table 1, a summary is given comparing the properties of selected SGMM alloys compared to examples of existing carbon based high strength fibers. As can be seen, while the tensile strength values may be in relatively the same range or may be even greater, relatively superior tensile elongation may be achieved in the SGMM alloys of the present disclosure.

Additionally, the nature of the elongation may be considered different since in the carbon based materials elongation involves the ability to stretch (i.e. elasticity) while in the SGMM alloys elongation involves both elasticity and the ability to permanently deform (i.e. plasticity). Another key consideration is that the maximum use temperature may be considered relatively higher in the SGMM alloys (465 to 1000° C.) compared to the relatively low temperature stability of the existing carbon based fibers (100 to 250° C.). The carbon based fibers exhibit relatively lower densities (0.9 to 1.5 g/cm$^3$) vs. the SGMM alloys which may exhibit densities from, for example, 6.5 g/cm$^3$ to 8.5 g/cm$^3$. Depending on the application, this difference in density can be an advantage and a disadvantage.

As state earlier, the carbon based fibers may suffer from environmental instability including temperature changes, UV stability, and loss of properties when exposed to water/water vapor. These sensitivities and weaknesses have not been observed in the SGMM iron based alloys of the present disclosure. Furthermore, the manufacturing approaches and resulting product forms for the carbon based aramid and polyethylene fibers may be different than the envisioned approaches (explained in subsequent sections) for the SGMM iron based alloys.

TABLE 1

Summary of Fiber Properties and Comparison to Disclosed Alloys

| Material | Manufacturer | Ultimate Tensile Strength (GPa) | Elongation (%) | Modulus (GPa) | Density (g/cm$^3$) | Maximum Temperature (° C.) |
|---|---|---|---|---|---|---|
| Spectra Fiber 900 | Honeywell | 2.6 | 3.9 | 73 | 0.97 | — |
| Spectra Fiber 1000 | Honeywell | 3.1 | 3.5 | 101 | 0.97 | 100 |
| Spectra Fiber 2000 | Honeywell | 3.3 | 2.8 | 113 | 0.97 | — |
| Kevlar 29 | Dupont | 3.6 | 3.6 | 83 | 1.44 | — |
| Kevlar 49 | Dupont | 3.6 | 2.4 | 124 | 1.44 | 250 |
| Vectran | Kuraray | 3.2 | 3.3 | 91 | 1.47 | 150 |
| Technora | Teijin | 3.3 | 4.3 | 70 | 1.39 | 250 |
| PC7E8S1A1 | Disclosed Alloy | 3.4 | 5.2 | 114 | 7.78 | 1000 |
| PC7E8S5A1 | Disclosed Alloy | 3.2 | 5.2 | 118 | 7.73 | 1000 |
| PC7e8S8A8 | Disclosed Alloy | 2.7 | 6.8 | 119 | 7.66 | 470 |
| PC7E9S1A1X5 | Disclosed Alloy | 3.7 | 5.7 | 130 | 7.73 | 465 |
| PC7e6Ha* | Disclosed Alloy | 4.3 | 5.3 | 145 | 7.75 | 430 |

*40 μm thick ribbons melt-spun at wheel tangential velocity of 16 m/s

EXAMPLE

Sample Preparation

Using high purity elements (i.e., exhibiting purities of 98 atomic % or greater), 15 g alloy feedstocks of the targeted alloys were weighed out according to the atomic ratio's provided in Tables 2 and 3. The feedstock material was then placed into the copper hearth of an arc-melting system. The feedstock was arc-melted into an ingot using high purity argon as a shielding gas. The ingots were flipped several times and remelted to ensure homogeneity. After mixing, the ingots were then cast in the form of a finger approximately 12 mm wide by 30 mm long and 8 mm thick. The resulting fingers were then placed in a melt-spinning chamber in a quartz crucible with a hole diameter of ~0.81 mm. The ingots were then processed in one processing condition by melting in a ⅓ atm helium atmosphere using RF induction and then ejected onto a 245 mm diameter copper wheel which was traveling at tangential velocities which typically were either 16 or 10.5 m/s. The resulting ribbons that were produced had widths which were typically ~1.25 mm and thickness from 0.06 to 0.08 mm as shown in Table 6. Note that the structure and properties of the resulting ribbons including their bending behavior will be sensitively dependant on specific processing conditions.

TABLE 2

Atomic Ratio's for Alloys

| Alloy | Fe | B | C | Si | Ni | Co |
|---|---|---|---|---|---|---|
| PC7E7 | 53.50 | 16.00 | 4.50 | 0.50 | 15.50 | 10.00 |
| PC7E8 | 63.00 | 12.49 | 4.54 | 0.47 | 16.50 | 3.00 |
| PC7E8S1A1 | 67.54 | 12.49 | 0.00 | 0.47 | 16.50 | 3.00 |
| PC7E8S1A2 | 66.04 | 12.49 | 1.50 | 0.47 | 16.50 | 3.00 |
| PC7E8S1A3 | 64.54 | 12.49 | 3.00 | 0.47 | 16.50 | 3.00 |
| PC7E8S1A4 | 63.00 | 12.49 | 4.54 | 0.47 | 16.50 | 3.00 |
| PC7E8S1A5 | 65.54 | 14.49 | 0.00 | 0.47 | 16.50 | 3.00 |
| PC7E8S1A6 | 64.04 | 14.49 | 1.50 | 0.47 | 16.50 | 3.00 |
| PC7E8S1A7 | 62.54 | 14.49 | 3.00 | 0.47 | 16.50 | 3.00 |

TABLE 2-continued

| Atomic Ratio's for Alloys | | | | | | |
|---|---|---|---|---|---|---|
| Alloy | Fe | B | C | Si | Ni | Co |
| PC7E8S1A8 | 61.00 | 14.49 | 4.54 | 0.47 | 16.50 | 3.00 |
| PC7E8S1A9 | 63.54 | 16.49 | 0.00 | 0.47 | 16.50 | 3.00 |
| PC7E8S1A10 | 62.04 | 16.49 | 1.50 | 0.47 | 16.50 | 3.00 |
| PC7E8S1A11 | 60.54 | 16.49 | 3.00 | 0.47 | 16.50 | 3.00 |
| PC7E8S1A12 | 59.00 | 16.49 | 4.54 | 0.47 | 16.50 | 3.00 |
| PC7E8S1A13 | 61.54 | 18.49 | 0.00 | 0.47 | 16.50 | 3.00 |
| PC7E8S1A14 | 60.04 | 18.49 | 1.50 | 0.47 | 16.50 | 3.00 |
| PC7E8S1A15 | 58.54 | 18.49 | 3.00 | 0.47 | 16.50 | 3.00 |
| PC7E8S1A16 | 57.00 | 18.49 | 4.54 | 0.47 | 16.50 | 3.00 |
| PC7E8S8A1 | 63.30 | 12.55 | 4.56 | 0.00 | 16.58 | 3.01 |
| PC7E8S8A2 | 63.00 | 12.49 | 4.54 | 0.47 | 16.50 | 3.00 |
| PC7E8S8A3 | 62.69 | 12.43 | 4.52 | 0.97 | 16.42 | 2.99 |
| PC7E8S8A4 | 62.37 | 12.37 | 4.49 | 1.47 | 16.34 | 2.97 |
| PC7E8S8A5 | 62.06 | 12.30 | 4.47 | 1.96 | 16.25 | 2.96 |
| PC7E8S8A6 | 61.74 | 12.24 | 4.45 | 2.46 | 16.17 | 2.94 |
| PC7E8S8A7 | 61.43 | 12.18 | 4.43 | 2.96 | 16.09 | 2.93 |
| PC7E8S8A8 | 61.11 | 12.12 | 4.40 | 3.46 | 16.01 | 2.91 |
| PC7E8S8A6X1 | 60.18 | 12.24 | 4.45 | 2.46 | 16.17 | 4.50 |
| PC7E8S8A6X2 | 58.68 | 12.24 | 4.45 | 2.46 | 16.17 | 6.00 |
| PC7E8S8A6X3 | 57.18 | 12.24 | 4.45 | 2.46 | 16.17 | 7.50 |
| PC7E9S1A1 | 61.55 | 16.49 | 0.00 | 2.46 | 16.50 | 3.0 |
| PC7E9S1A2 | 60.05 | 16.49 | 1.50 | 2.46 | 16.50 | 3.0 |
| PC7E9S1A3 | 58.55 | 16.49 | 3.00 | 2.46 | 16.50 | 3.0 |
| PC7E9S1A4 | 57.05 | 16.49 | 4.50 | 2.46 | 16.50 | 3.0 |
| PC7E9S1A5 | 55.55 | 16.49 | 6.00 | 2.46 | 16.50 | 3.0 |
| PC7E9S1A1X1 | 60.05 | 16.49 | 0.00 | 2.46 | 16.50 | 4.50 |
| PC7E9S1A1X2 | 58.55 | 16.49 | 0.00 | 2.46 | 16.50 | 6.00 |
| PC7E9S1A1X3 | 57.05 | 16.49 | 0.00 | 2.46 | 16.50 | 7.50 |
| PC7E9S1A1X4 | 55.55 | 16.49 | 0.00 | 2.46 | 16.50 | 9.00 |
| PC7E9S1A1X5 | 54.05 | 16.49 | 0.00 | 2.46 | 16.50 | 10.50 |
| PC7E9S1A1X6 | 52.55 | 16.49 | 0.00 | 2.46 | 16.50 | 12.00 |
| PC7E9S1A1X7 | 51.05 | 16.49 | 0.00 | 2.46 | 16.50 | 13.50 |
| PC7E9S1A1X8 | 49.55 | 16.49 | 0.00 | 2.46 | 16.50 | 15.00 |
| PC7E9S1A1X9 | 48.05 | 16.49 | 0.00 | 2.46 | 16.50 | 16.50 |
| PC7E9S1A1X10 | 46.55 | 16.49 | 0.00 | 2.46 | 16.50 | 18.00 |
| PC7E9S1A1X11 | 45.05 | 16.49 | 0.00 | 2.46 | 16.50 | 19.50 |
| PC7E9S1A1X12 | 43.55 | 16.49 | 0.00 | 2.46 | 16.50 | 21.00 |

TABLE 3

| Atomic Ratio's for Alloys | | | | | | | |
|---|---|---|---|---|---|---|---|
| Alloy | Fe | B | C | Si | Ni | Co | |
| | | | | | | | Ti |
| PC7E8S2A1 | 62.37 | 12.37 | 4.49 | 0.47 | 16.34 | 2.97 | 1 |
| PC7E8S2A2 | 61.74 | 12.24 | 4.45 | 0.46 | 16.17 | 2.94 | 2 |
| PC7E8S2A3 | 60.48 | 11.99 | 4.36 | 0.45 | 15.84 | 2.88 | 4 |
| PC7E8S2A4 | 57.96 | 11.49 | 4.18 | 0.43 | 15.18 | 2.76 | 8 |
| | | | | | | | Mo |
| PC7E8S3A1 | 62.37 | 12.37 | 4.49 | 0.47 | 16.34 | 2.97 | 1 |
| PC7E8S3A2 | 61.74 | 12.24 | 4.45 | 0.46 | 16.17 | 2.94 | 2 |
| PC7E8S3A3 | 60.48 | 11.99 | 4.36 | 0.45 | 15.84 | 2.88 | 4 |
| PC7E8S3A4 | 57.96 | 11.49 | 4.18 | 0.43 | 15.18 | 2.76 | 8 |
| | | | | | | | Cu |
| PC7E8S4A1 | 62.37 | 12.37 | 4.49 | 0.47 | 16.34 | 2.97 | 1 |
| PC7E8S4A2 | 61.74 | 12.24 | 4.45 | 0.46 | 16.17 | 2.94 | 2 |
| PC7E8S4A3 | 60.48 | 11.99 | 4.36 | 0.45 | 15.84 | 2.88 | 4 |
| PC7E8S4A4 | 57.96 | 11.49 | 4.18 | 0.43 | 15.18 | 2.76 | 8 |
| | | | | | | | Al |
| PC7E8S6A1 | 61.74 | 12.24 | 4.45 | 0.46 | 16.17 | 2.94 | 2 |
| PC7E8S6A2 | 60.48 | 11.99 | 4.36 | 0.45 | 15.84 | 2.88 | 4 |
| PC7E8S6A3 | 57.96 | 11.49 | 4.18 | 0.43 | 15.18 | 2.76 | 8 |
| PC7E8S6A4 | 55.44 | 10.99 | 4.00 | 0.41 | 14.52 | 2.64 | 12 |
| PC7E8S6A5 | 52.92 | 10.49 | 3.81 | 0.39 | 13.86 | 2.52 | 16 |

TABLE 3-continued

| Atomic Ratio's for Alloys | | | | | | | |
|---|---|---|---|---|---|---|---|
| Alloy | Fe | B | C | Si | Ni | Co | |
| | | | | | | | Ce |
| PC7E8S7A1 | 62.37 | 12.37 | 4.49 | 0.47 | 16.34 | 2.97 | 1 |
| PC7E8S7A2 | 61.74 | 12.24 | 4.45 | 0.46 | 16.17 | 2.94 | 2 |
| PC7E8S7A3 | 60.48 | 11.99 | 4.36 | 0.45 | 15.84 | 2.88 | 4 |
| PC7E8S7A4 | 57.96 | 11.49 | 4.18 | 0.43 | 15.18 | 2.76 | 8 |

Density

The density of the alloys in ingot form was measured using the Archimedes method in a specially constructed balance allowing weighing in both air and distilled water. The density of the arc-melted 15 gram ingots for each alloy is tabulated in Table 4 and was found to vary from 6.90 g/cm$^3$ to 8.05 g/cm$^3$. Experimental results have revealed that the accuracy of this technique is +−0.01 g/cm$^3$.

TABLE 4

| Density of Alloys | |
|---|---|
| Alloy | Density (g/cm$^3$) |
| PC7E7 | 7.73 |
| PC7E8 | 7.75 |
| PC7E8S1A1 | 7.78 |
| PC7E8S1A2 | 7.77 |
| PC7E8S1A3 | 7.76 |
| PC7E8S1A4 | 7.75 |
| PC7E8S1A5 | 7.76 |
| PC7E8S1A6 | 7.74 |
| PC7E8S1A7 | 7.72 |
| PC7E8S1A8 | 7.69 |
| PC7E8S1A9 | 7.75 |
| PC7E8S1A10 | 7.70 |
| PC7E8S1A11 | 7.66 |
| PC7E8S1A12 | 7.63 |
| PC7E8S1A13 | 7.74 |
| PC7E8S1A14 | 7.68 |
| PC7E8S1A15 | 7.64 |
| PC7E8S1A16 | 7.60 |
| PC7E8S8A1 | 7.77 |
| PC7E8S8A2 | 7.75 |
| PC7E8S8A3 | 7.74 |
| PC7E8S8A4 | 7.72 |
| PC7E8S8A5 | 7.70 |
| PC7E8S8A6 | 7.68 |
| PC7E8S8A7 | 7.67 |
| PC7E8S8A8 | 7.66 |
| PC7E8S8A6X1 | 7.68 |
| PC7E8S8A6X2 | 7.70 |
| PC7E8S8A6X3 | 7.72 |
| PC7E9S1A1 | 7.68 |
| PC7E9S1A2 | 7.63 |
| PC7E9S1A3 | 7.59 |
| PC7E9S1A4 | 7.56 |
| PC7E9S1A5 | 7.44 |
| PC7E9S1A1X1 | 7.75 |
| PC7E9S1A1X2 | 7.73 |
| PC7E9S1A1X3 | 7.73 |
| PC7E9S1A1X4 | 7.73 |
| PC7E9S1A1X5 | 7.73 |
| PC7E9S1A1X6 | 7.76 |
| PC7E9S1A1X7 | 7.77 |
| PC7E9S1A1X8 | 7.78 |
| PC7E9S1A1X9 | 7.80 |
| PC7E9S1A1X10 | 7.81 |
| PC7E9S1A1X11 | 7.82 |
| PC7E9S1A1X12 | 7.83 |
| PC7E8S2A1 | 7.70 |
| PC7E8S2A2 | 7.63 |
| PC7E8S2A3 | 7.48 |

TABLE 4-continued

Density of Alloys

| Alloy | Density ($g/cm^3$) |
|---|---|
| PC7E8S2A4 | 7.23 |
| PC7E8S3A1 | 7.78 |
| PC7E8S3A2 | 7.82 |
| PC7E8S3A3 | 7.89 |
| PC7E8S3A4 | 8.05 |
| PC7E8S4A1 | 7.76 |
| PC7E8S4A2 | 7.77 |
| PC7E8S4A3 | 7.79 |
| PC7E8S4A4 | 7.82 |
| PC7E8S6A1 | 7.68 |
| PC7E8S6A2 | 7.53 |
| PC7E8S6A3 | 7.34 |
| PC7E8S6A4 | 7.10 |
| PC7E8S6A5 | 6.90 |
| PC7E8S7A1 | 7.71 |
| PC7E8S7A2 | 7.66 |
| PC7E8S7A3 | 7.63 |
| PC7E8S7A4 | 7.55 |

Thermal Analysis

Figure 4:
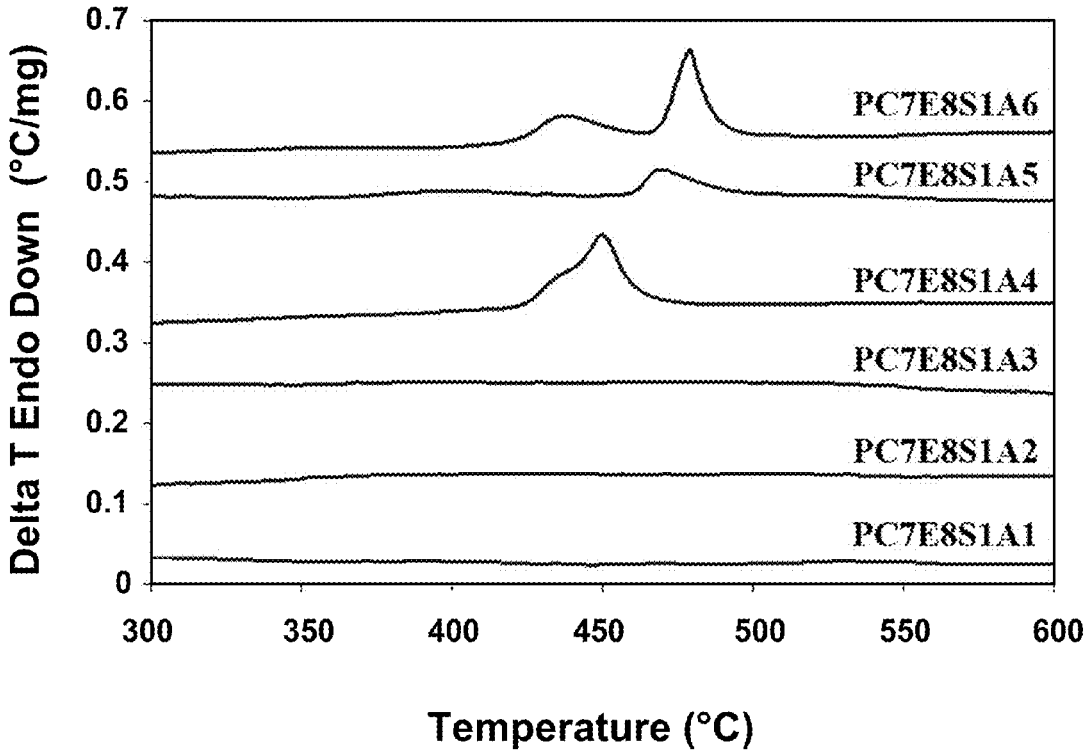
FIG. 4 illustrates DTA curves of the following alloys melt spun at 10.5 m/s; wherein FIG. 4*a*) illustrates a DTA curve for PC7E8S1A1, FIG. 4*b*) illustrates a DTA curve for PC7E8S1A2, FIG. 4*c*) illustrates a DTA curve for PC7E8S1A3, FIG. 4*d*) illustrates a DTA curve for PC7E8S1A4, FIG. 4*e*) illustrates a DTA curve for PC7E8S1A5, and FIG. 4*f*) illustrates a DTA curve for PC7E8S1A6.

Thermal analysis was done on the as-solidified ribbon structure on a Perkin Elmer DTA-7 system with the DSC-7 option. Differential thermal analysis (DTA) and differential scanning calorimetry (DSC) was performed at a heating rate of 10° C./minute with samples protected from oxidation through the use of flowing ultrahigh purity argon. In Table 5, the DSC data related to the glass to crystalline transformation is shown for the alloys that have been melt-spun at 10.5 m/s. As can be seen, the majority of samples exhibit glass to crystalline transformations verifying that the as-spun state contains significant fractions of metallic glass. In FIG. 4, the corresponding DTA plots are shown for the PC7E8S1A1, PC7E8S1A2, PC7E8S1A3, PC7E8S1A4, PC7E8S1A5, and PC7E8S1A6 alloys melt-spun at 10.5 m/s. The glass to crystalline transformation occurs in either one stage or two stages in the range of temperature from 366° C. to 633° C. and with enthalpies of transformation from −8.9 J/g to −173.9 J/g.

TABLE 5

DSC Data for Glass to Crystalline Transformations at 10.5 m/s

| Alloy | Glass | Peak #1 Onset (° C.) | Peak #1 Peak (° C.) | ΔH (-J/g) | Peak #2 Onset (° C.) | Peak #2 Peak (° C.) | ΔH (-J/g) |
|---|---|---|---|---|---|---|---|
| PC7E7 | Y | 468 | 473 | 127.2 | | | |
| PC7E8 | Y | 433 | 444 | 46.2 | 476 | 481 | 99.0 |
| PC7E8S1A1 | N | | | | | | |
| PC7E8S1A2 | N | | | | | | |
| PC7E8S1A3 | N | | | | | | |
| PC7E8S1A4 | Y | 435 | 450 | 164.0 | | | |
| PC7E8S1A5 | Y | 366 | 403 | 22.2 | 461 | 470 | 55.3 |
| PC7E8S1A6 | Y | 422 | 438 | 53.2 | 470 | 479 | 107.3 |
| PC7E8S1A7 | Y | 440 | 449 | 24.4 | 471 | 477 | 75.5 |
| PC7E8S1A8 | Y | 447 | 455 | 10.7 | 471 | 476 | 39.4 |
| PC7E8S1A9 | Y | 427 | 434 | 10.0 | 440 | 451 | 85.4 |
| PC7E8S1A10 | Y | 445 | 467 | 122.0 | | | |
| PC7E8S1A11 | Y | 463 | 470 | 117.1 | | | |
| PC7E8S1A12 | Y | 466 | 471 | 122.0 | | | |
| PC7E8S1A13 | Y | 451 | 460 | 133.1 | | | |
| PC7E8S1A14 | Y | 461 | 467 | 122.3 | | | |
| PC7E8S1A15 | Y | 470 | 476 | 115.9 | | | |
| PC7E8S1A16 | Y | 506 | 532 | 17.0 | | | |
| PC7E8S8A1 | Y | 432 | 447 | 173.9 | | | |
| PC7E8S8A2 | Y | 433 | 444 | 46.2 | 476 | 481 | 99.0 |
| PC7E8S8A3 | Y | 436 | 446 | 38.7 | 479 | 485 | 72.9 |
| PC7E8S8A4 | Y | 443 | 453 | 36.7 | 485 | 491 | 74.0 |

TABLE 5-continued

DSC Data for Glass to Crystalline Transformations at 10.5 m/s

| Alloy | Glass | Peak #1 Onset (° C.) | Peak #1 Peak (° C.) | ΔH (-J/g) | Peak #2 Onset (° C.) | Peak #2 Peak (° C.) | ΔH (-J/g) |
|---|---|---|---|---|---|---|---|
| PC7E8S8A5 | Y | 453 | 464 | 34.9 | 491 | 498 | 64.4 |
| PC7E8S8A6 | Y | 466 | 474 | 49.7 | 495 | 507 | 39.8 |
| PC7E8S8A7 | Y | 466 | 475 | 54.8 | 504 | 513 | 68.0 |
| PC7E8S8A8 | Y | 476 | 484 | 42.0 | 510 | 522 | 14.0 |
| PC7E8S8A6X1 | Y | 456 | 464 | 21.5 | 488 | 497 | 7.8 |
| PC7E8S8A6X2 | Y | 455 | 464 | 13.5 | 490 | 498 | 2.5 |
| PC7E8S8A6X3 | Y | 455 | 463 | 8.9 | 491 | 499 | 1.9 |
| PC7E9S1A1 | Y | 461 | 467 | 60.0 | 475 | 480 | 87.0 |
| PC7E9S1A2 | Y | 469 | 475 | 131.0 | 606 | 618 | 7.7 |
| PC7E9S1A3 | Y | 476 | 482 | 120.0 | | | |
| PC7E9S1A4 | Y | 496 | 502 | 134.0 | | | |
| PC7E9S1A5 | Y | 497 | 502 | 133.0 | | | |
| PC7E9S1A1X1 | Y | 463 | 468 | 50.0 | 476 | 483 | 76.0 |
| PC7E9S1A1X2 | Y | 462 | 467 | 50.0 | 477 | 484 | 81.0 |
| PC7E9S1A1X3 | Y | 465 | 473 | 53.0 | 479 | 486 | 54.0 |
| PC7E9S1A1X4 | Y | 463 | 470 | 49.6 | 480 | 487 | 54.6 |
| PC7E9S1A1X5 | Y | 465 | 471 | 15.2 | 482 | 490 | 15.3 |
| PC7E9S1A1X6 | Y | 465 | 472 | 18.0 | 483 | 490 | 26.0 |
| PC7E9S1A1X7 | Y | 463 | 471 | 25.6 | 484 | 491 | 36.0 |
| PC7E9S1A1X8 | Y | 466 | 472 | 24.0 | 483 | 491 | 34.9 |
| PC7E9S1A1X9 | Y | 465 | 472 | 12.0 | 487 | 492 | 15.9 |
| PC7E9S1A1X10 | Y | 456 | 468 | 24.1 | 488 | 494 | 60.3 |
| PC7E9S1A1X11 | Y | 461 | 472 | 10.3 | 491 | 496 | 15.8 |
| PC7E9S1A1X12 | Y | 461 | 473 | 26.5 | 492 | 498 | 40.6 |
| PC7E8S2A1 | N | | | | | | |
| PC7E8S2A2 | N | | | | | | |
| PC7E8S2A3 | N | | | | | | |
| PC7E8S2A4 | N | | | | | | |
| PC7E8S3A1 | N | | | | | | |
| PC7E8S3A2 | Y | 431 | 442 | 42.0 | 497 | 502 | 58.5 |
| PC7E8S3A3 | Y | 431 | 440 | 33.6 | 503 | 508 | 54.2 |
| PC7E8S3A4 | Y | 444 | 457 | 16.9 | 535 | 544 | 61.3 |
| PC7E8S4A1 | Y | 433 | 444 | 46.2 | 476 | 481 | 99.0 |
| PC7E8S4A2 | Y | 405 | 415 | 39.5 | 469 | 474 | 71.0 |
| PC7E8S4A3 | N | | | | | | |
| PC7E8S4A4 | N | | | | | | |
| PC7E8S6A1 | N | | | | | | |
| PC7E8S6A2 | N | | | | | | |
| PC7E8S6A3 | N | | | | | | |
| PC7E8S6A4 | N | | | | | | |
| PC7E8S6A5 | N | | | | | | |
| PC7E8S7A1 | Y | 432 | 443 | 33.6 | 503 | 511 | 41.7 |
| PC7E8S7A2 | Y | 443 | 456 | 7.7 | 515 | 522 | 4.1 |
| PC7E8S7A3 | Y | 480 | 493 | 62.6 | 596 | 605 | 4.1 |
| PC7E8S7A4 | Y | 556 | 562 | 16.0 | 622 | 633 | 12.3 |

Overlapping peaks, peak 1 and peak 2 enthalpy combined

Bending Behavior

Figure 5:
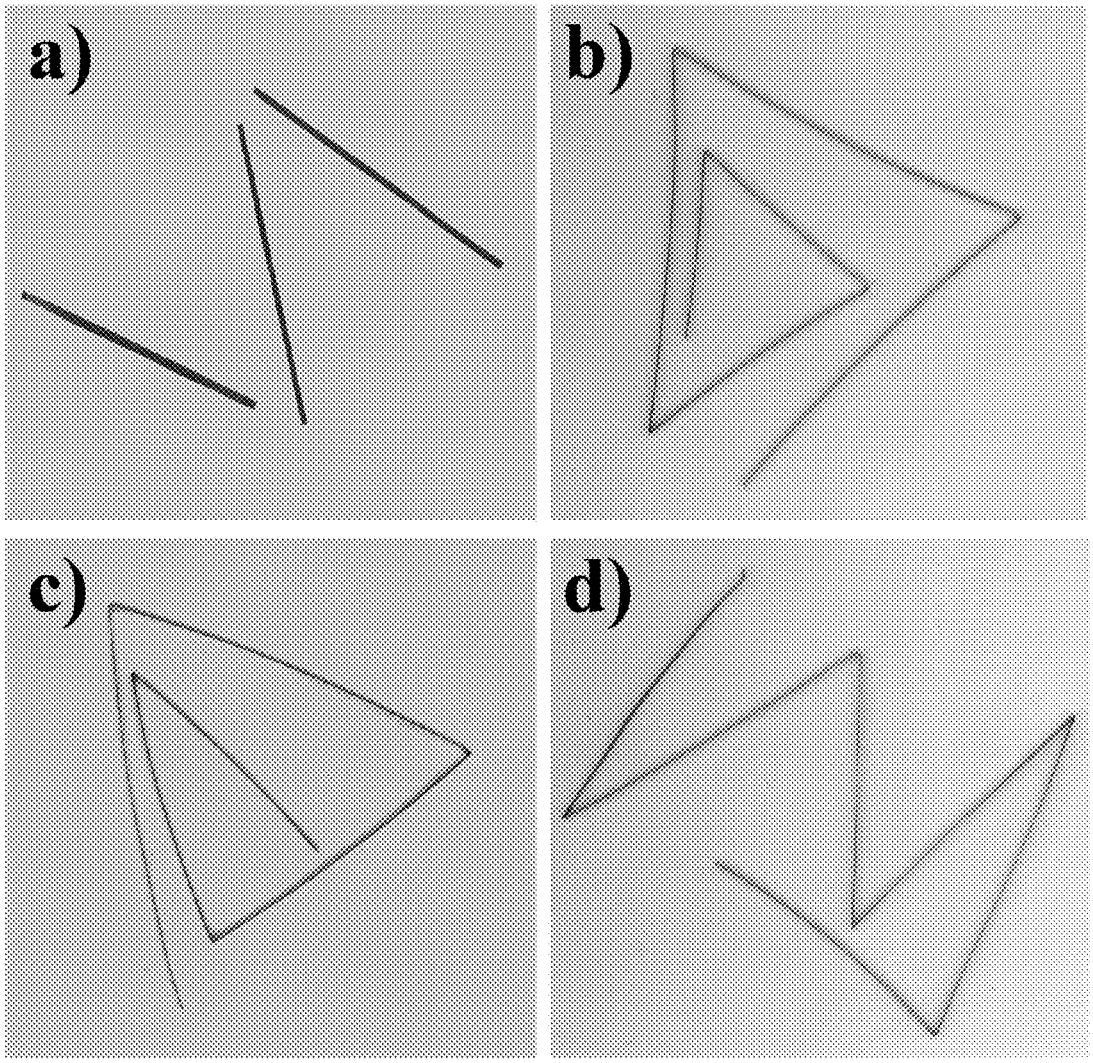
FIG. 5 illustrates typical example ribbons which were bent 180° showing the 4 types of bending behavior.
Figure 6:
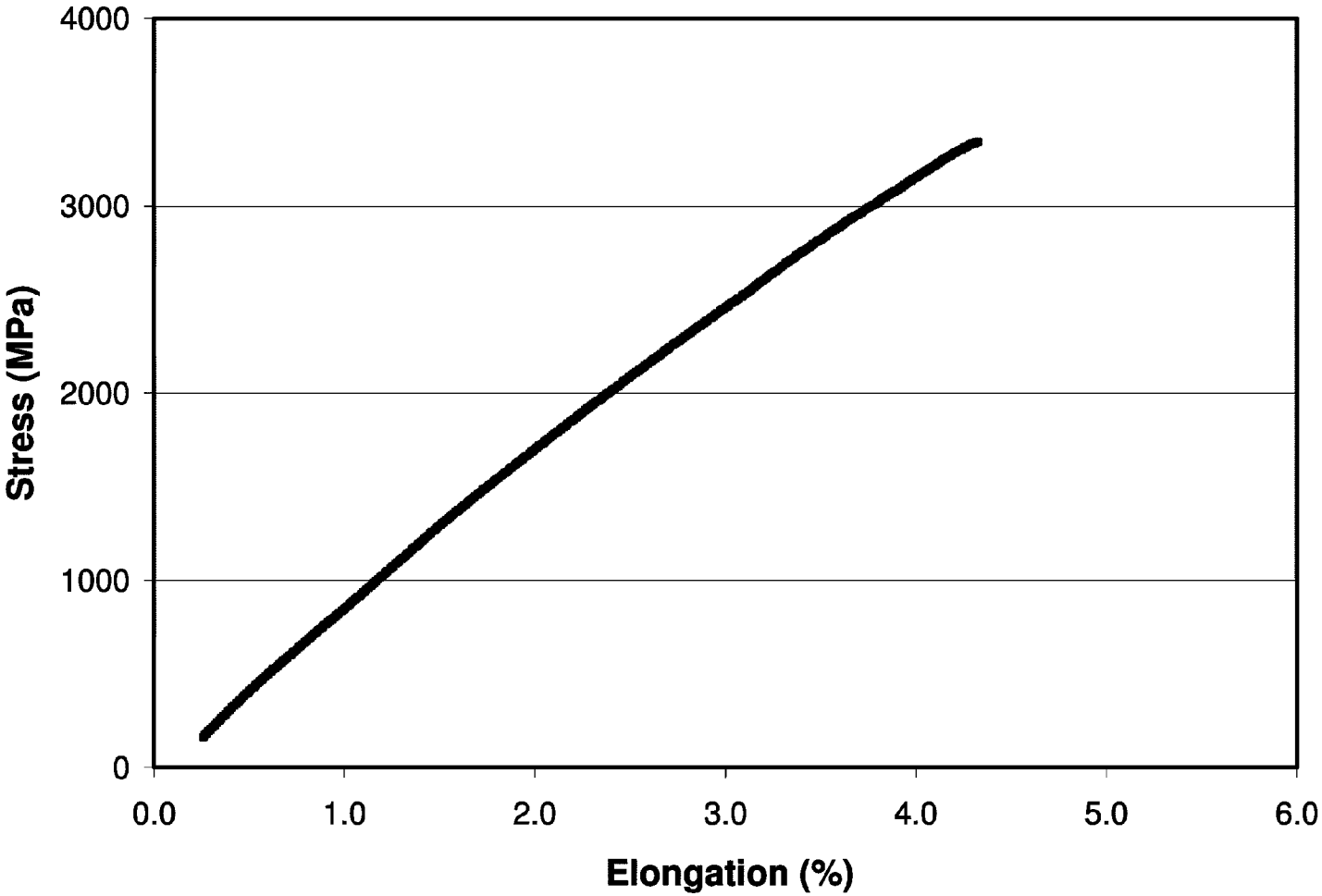
FIG. 6 illustrates an example of a tensile stress-strain curve for PC7E8S1A1X4 ribbon melt spun at 10.5 m/s.
Figure 7:
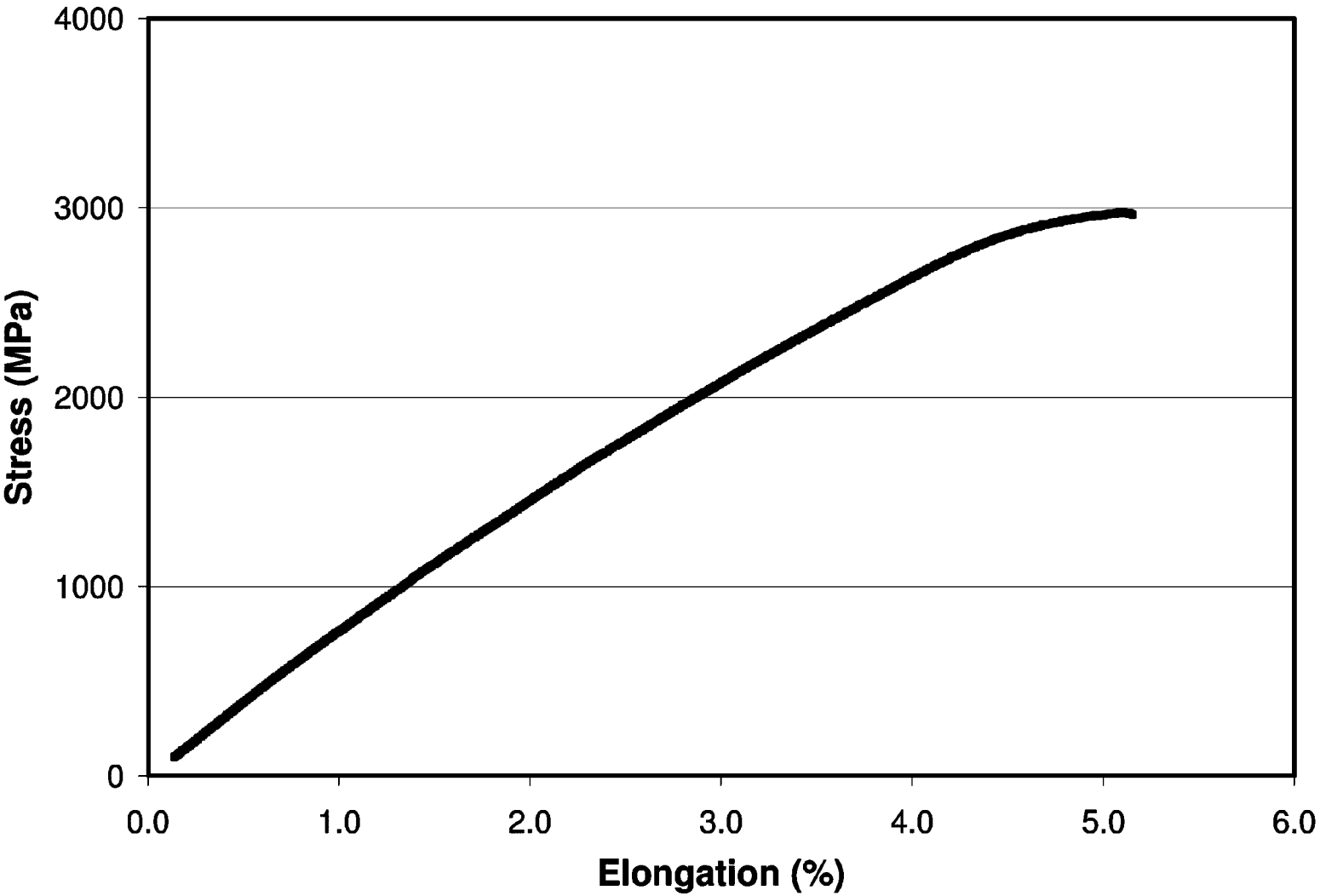
FIG. 7 illustrates an example of a tensile stress-strain curve for PC7E8S1A1X6 ribbon melt spun at 10.5 m/s.
Figure 8:
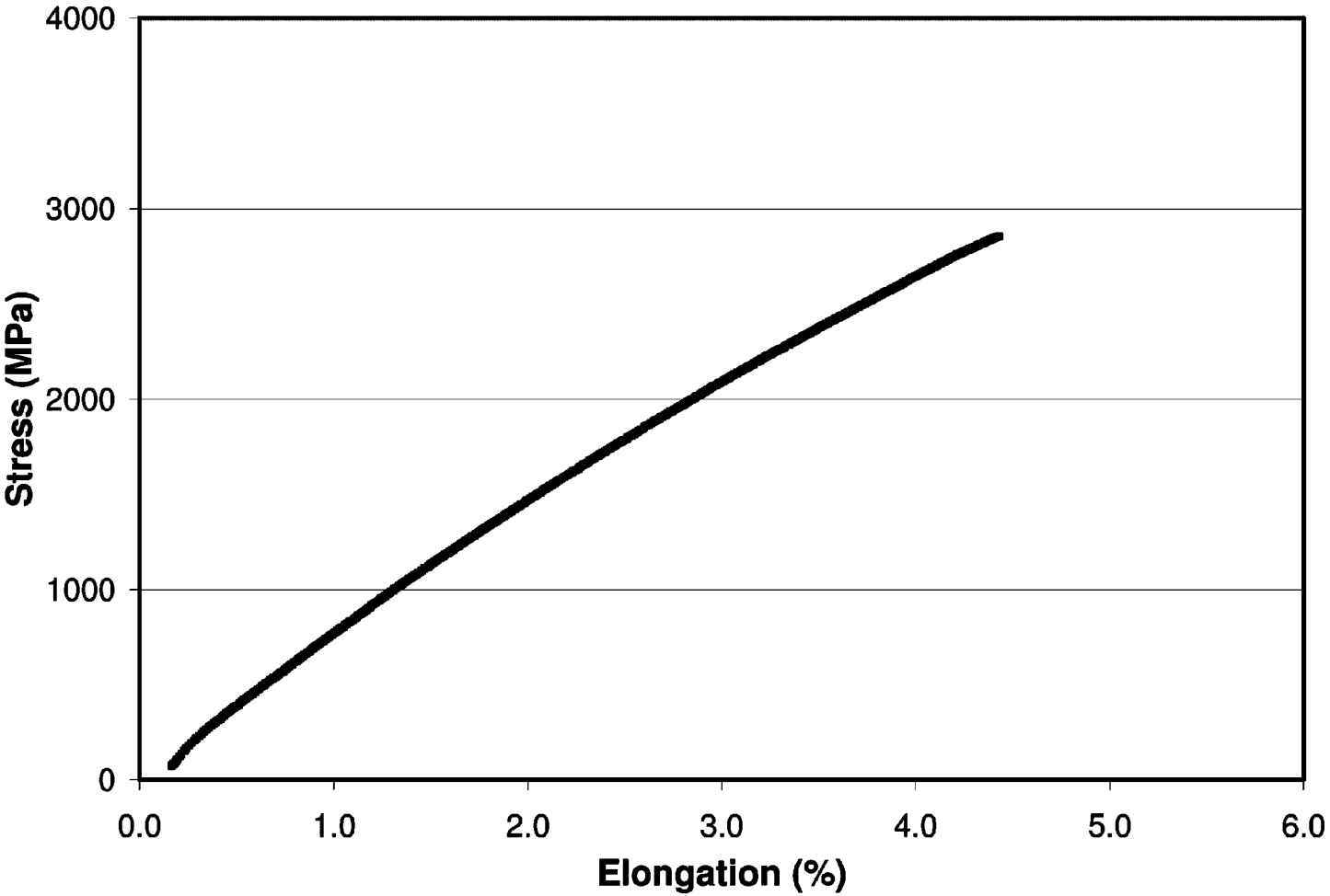
FIG. 8 illustrates an example of a tensile stress-strain curve for PC7E8S1A1X12 ribbon melt spun at 10.5 m/s.

The ability of the ribbons to bend completely flat may indicate a ductile condition whereby relatively high strain can be obtained but not measured by traditional bend testing. When the ribbons are folded completely around themselves, they may experience high strain which can be as high as 119.8% as derived from complex mechanics. In practice, the strain may be in the range of ±57% to ~97% strain in the tension side of the ribbon. During 180° bending (i.e. flat), four types of behavior were observed; Type 1 Behavior—not bendable without breaking, Type 2 Behavior—bendable on one side with wheel side out, Type 3 Behavior—bendable on one side with free side out, and Type 4 Behavior—bendable on both sides. Reference to "wheel side" may be understood as the side of the ribbon which contacted the wheel during melting spinning. In Table 6, a summary of the 180° bending results including the specific behavior type are shown for the studied alloys processed at 10.5 m/s. In FIG. 5, optical pictures are shown for various ribbon samples after 180° bending representing examples of the 4 different types of bending behavior. Note that the bending behavior observed is representative of the specific alloy processed under the specific condition listed in the Sample Preparation section. Alternate processing parameters are expected to change bendability. For example, an alloy which experiences a Type 1 bending behavior in Table 6, may be expected to achieve a Type 2, 3, or 4 bending behavior under different processing conditions as long as the favorable SGMM structure is achieved.

TABLE 6

Summary of Ribbon Thickness and Bending Behavior at 10.5 m/s

| Alloy | Thickness (μm) | Bending Response Alloy | Behavior Type |
|---|---|---|---|
| PC7E7 | 70 to 80 | Bendable on free side | Type 3 |
| PC7E8 | 70 | Brittle on both sides | Type 1 |
| PC7E8S1A1 | 70 | Brittle on both sides | Type 1 |
| PC7E8S1A2 | 70 | Brittle on both sides | Type 1 |
| PC7E8S1A3 | 70 | Bendable on wheel side along entire length | Type 2 |
| PC7E8S1A4 | 70 | Bendable on wheel side at isolated spots | Type 2 |
| PC7E8S1A5 | 70 | Brittle on both sides | Type 1 |
| PC7E8S1A6 | 70 | Bendable on wheel side at isolated spots | Type 2 |
| PC7E8S1A7 | 70 | Bendable on wheel side along entire length | Type 2 |
| PC7E8S1A8 | 70 | Bendable on wheel side at isolated spots | Type 2 |
| PC7E8S1A9 | 70 | Bendable on both sides along entire length | Type 4 |
| PC7E8S1A10 | 70 | Bendable on both sides; breaks at isolated spots | Type 4 |
| PC7E8S1A11 | 70 | Bendable on wheel side at isolated spots | Type 2 |
| PC7E8S1A12 | 70 | Brittle on both sides | Type 1 |
| PC7E8S1A13 | 70 | Bendable on both sides; breaks at isolated spots on wheel side | Type 4 |
| PC7E8S1A14 | 70 | Bendable on free side | Type 3 |
| PC7E8S1A15 | 70 | Brittle on both sides | Type 1 |
| PC7E8S1A16 | 70 | Brittle on both sides | Type 1 |
| PC7E8S8A1 | 70 | Brittle on both sides | Type 1 |
| PC7E8S8A2 | 70 | Bendable on wheel side along entire length | Type 2 |
| PC7E8S8A3 | 70 | Bendable on wheel side along entire length | Type 2 |
| PC7E8S8A4 | 70 | Bendable on wheel side along entire length | Type 2 |
| PC7E8S8A5 | 70 | Bendable on both sides along entire length | Type 4 |
| PC7E8S8A6 | 70 | Bendable on both sides along entire length | Type 4 |
| PC7E8S8A7 | 70 | Bendable on both sides along entire length | Type 4 |
| PC7E8S8A8 | 70 | Bendable on wheel side; breaks at isolated spots | Type 2 |
| PC7E8S8A6X1 | 70 | Bendable on both side along entire length | Type 4 |
| PC7E8S8A6X2 | 70 | Bendable on both side; breaks at isolated spots | Type 4 |
| PC7E8S8A6X3 | 70 | Bendable on wheel side only | Type 2 |
| PC7E9S1A1 | 70-80 | Bendable on both side along entire length | Type 4 |
| PC7E9S1A2 | 80 | Bendable on both side along entire length | Type 4 |
| PC7E9S1A3 | 80 | Bendable on both side; breaks at isolated spots | Type 4 |
| PC7E9S1A4 | 70-80 | Brittle on both sides | Type 1 |
| PC7E9S1A5 | 60-70 | Brittle on both sides | Type 1 |
| PC7E9S1A1X1 | 60-70 | Bendable on both side; breaks at isolated spots | Type 4 |
| PC7E9S1A1X2 | 60-70 | Bendable on both side along entire length | Type 4 |
| PC7E9S1A1X3 | 70-80 | Bendable on both side along entire length | Type 4 |
| PC7E9S1A1X4 | 70-80 | Bendable on both side along entire length | Type 4 |
| PC7E9S1A1X5 | 70-80 | Bendable on both side along entire length | Type 4 |
| PC7E9S1A1X6 | 70-80 | Bendable on both side along entire length | Type 4 |
| PC7E9S1A1X7 | 70-80 | Bendable on both side along entire length | Type 4 |
| PC7E9S1A1X8 | 70-80 | Bendable on both side along entire length | Type 4 |
| PC7E9S1A1X9 | 70-80 | Bendable on both side along entire length | Type 4 |
| PC7E9S1A1X10 | 70-80 | Bendable on both side along entire length | Type 4 |
| PC7E9S1A1X11 | 70-80 | Bendable on both side along entire length | Type 4 |
| PC7E9S1A1X12 | 70-80 | Bendable on both side along entire length | Type 4 |
| PC7E8S2A1 | 80 | Brittle on both sides | Type 1 |
| PC7E8S2A2 | 80 | Brittle on both sides | Type 1 |
| PC7E8S2A3 | 90 | Brittle on both sides | Type 1 |
| PC7E8S2A4 | 110 | Brittle on both sides | Type 1 |
| PC7E8S3A1 | 80 | Brittle on both sides | Type 1 |
| PC7E8S3A2 | 80 | Brittle on both sides | Type 1 |
| PC7E8S3A3 | 70 | Bendable on wheel side at isolated spots | Type 2 |
| PC7E8S3A4 | 70 | Brittle on both sides | Type 1 |
| PC7E8S4A1 | 80-90 | Bendable on wheel side at entire length | Type 2 |
| PC7E8S4A2 | 80-90 | Brittle on both sides | Type 1 |
| PC7E8S4A3 | 80-90 | Brittle on both sides | Type 1 |
| PC7E8S4A4 | 80-90 | Brittle on both sides | Type 1 |
| PC7E8S6A1 | 70 | Brittle on both sides | Type 1 |
| PC7E8S6A2 | 30 | Brittle on both sides | Type 1 |
| PC7E8S6A3 | 70 | Brittle on both sides | Type 1 |
| PC7E8S6A4 | 70 | Brittle on both sides | Type 1 |
| PC7E8S6A5 | 70 | Brittle on both sides | Type 1 |
| PC7E8S7A1 | 60-70 | Brittle on both sides | Type 1 |

TABLE 6-continued

Summary of Ribbon Thickness and Bending Behavior at 10.5 m/s

| Alloy | Thickness (μm) | Bending Response Alloy | Behavior Type |
|---|---|---|---|
| PC7E8S7A2 | 60-70 | Brittle on both sides | Type 1 |
| PC7E8S7A3 | 50-60 | Brittle on both sides | Type 1 |
| PC7E8S7A4 | 50-60 | Brittle on both sides | Type 1 |

Tensile Properties

The mechanical properties of metallic ribbons were obtained at room temperature using microscale tensile testing. The testing was carried out in a commercial tensile stage made by Fullam which was monitored and controlled by a MTEST Windows software program. The deformation was applied by a stepping motor through the gripping system while the load was measured by a load cell that was connected to the end of one gripping jaw. Displacement was obtained using a Linear Variable Differential Transformer (LVDT) which was attached to the two gripping jaws to measure the change of gauge length. Before testing, the thickness and width of a ribbon were carefully measured for at least three times at different locations in the gauge length. The average values were then recorded as gauge thickness and width, and used as input parameters for subsequent stress and strain calculation. The initial gauge length for tensile testing was set at ~7 mm or ~9 mm with the exact value determined after the ribbon was fixed, by accurately measuring the ribbon span between the front faces of the two gripping jaws. All tests were performed under displacement control, with a strain rate of ~0.001 $s^{-1}$. A summary of the tensile test results including total elongation, yield strength, ultimate tensile strength, Young's Modulus, Modulus of Resilience are shown for each alloy in Table 7 when melt-spun at 10.5 m/s. In FIGS. 3, 4, and 5, example tensile stress-strain curves are shown. Note that the results shown in Table 7 have been adjusted for machine compliance and have been measured at a long gauge length of 7 to 9 mm. Also, note that each distinct sample was measured in triplicate since occasional macrodefects arising from the melt-spinning process may lead to localized areas with reduced properties. As can be seen the tensile strength values are relatively high and vary from 1.08 GPa to 3.70 GPa while the total elongation values are also very high and vary from 1.72% to 6.80%. The combination of strength and ductility may be considered exceptional and unknown in existing materials. The ability of the samples to exhibit strain hardening like a crystalline metal but with a primary glass structure may be considered anomalous to what may be found in other metallic glass samples.

TABLE 7

Summary of Tensile Test Results at 10.5 m/s

| Alloy | Total Elongation (%) | Yield Strength (GPa) | UTS (GPa) | Young's Modulus (GPa) | Modulus of Resilience (MPa) |
|---|---|---|---|---|---|
| PC7e7 | 2.43 | 1.40 | 2.70 | 139.0 | 2.96 |
| | 1.54 | 1.30 | 1.34 | 105.7 | 3.59 |
| | 2.16 | 1.07 | 1.83 | 125.0 | 2.06 |
| PC7e8 | 4.16 | 1.00 | 2.68 | 124.6 | 4.01 |
| | 2.43 | 0.93 | 1.48 | 116.1 | 3.72 |
| | 3.61 | 0.70 | 2.38 | 126.1 | 1.94 |
| PC7E8S1A1 | 2.85 | 0.98 | 1.45 | 106.2 | 5.52 |
| | 3.26 | 1.15 | 1.68 | 117.5 | 5.60 |
| | 2.87 | 0.85 | 1.42 | 104.0 | 3.47 |

TABLE 7-continued

Summary of Tensile Test Results at 10.5 m/s

| Alloy | Total Elongation (%) | Yield Strength (GPa) | UTS (GPa) | Young's Modulus (GPa) | Modulus of Resilience (MPa) |
|---|---|---|---|---|---|
| PC7E8S1A2 | 2.56 | 0.98 | 1.41 | 104.4 | 4.60 |
| | 2.07 | 1.09 | 1.49 | 131.4 | 4.52 |
| | 2.43 | 1.12 | 1.48 | 131.0 | 4.79 |
| PC7E8S1A3 | 2.98 | 1.02 | 1.98 | 130.5 | 3.99 |
| | 2.77 | 1.06 | 1.75 | 124.2 | 4.52 |
| | 2.83 | 0.46 | 1.15 | 119.3 | 0.89 |
| PC7E8S1A4 | 2.00 | 0.70 | 1.23 | 125.1 | 1.96 |
| | 3.81 | 0.54 | 1.38 | 73.8 | 1.96 |
| | 2.58 | 0.37 | 1.19 | 92.7 | 0.74 |
| PC7E8S1A5 | 3.04 | 0.64 | 2.01 | 112.5 | 1.82 |
| | 3.94 | 0.79 | 2.38 | 121.1 | 2.58 |
| | 3.21 | 0.77 | 1.94 | 112.1 | 2.64 |
| PC7E8S1A6 | 2.33 | 0.76 | 1.57 | 123.3 | 2.34 |
| | 2.33 | 0.62 | 1.50 | 116.1 | 1.66 |
| | 4.27 | 0.87 | 2.76 | 128.7 | 2.94 |
| PC7E8S1A7 | 4.99 | 0.65 | 2.79 | 115.3 | 1.83 |
| | 4.53 | 0.54 | 2.49 | 104.9 | 1.39 |
| | 4.42 | 0.81 | 2.74 | 138.7 | 2.48 |
| PC7E8S1A8 | 3.75 | 0.97 | 2.09 | 103.5 | 4.54 |
| | 6.09 | 0.77 | 3.15 | 119.3 | 2.48 |
| | 2.40 | 0.98 | 1.93 | 129.7 | 3.70 |
| PC7E8S1A9 | 2.80 | 0.51 | 1.92 | 137.5 | 0.95 |
| | 3.08 | 0.53 | 1.76 | 116.3 | 1.21 |
| | 3.73 | 0.68 | 2.45 | 116.3 | 1.99 |
| PC7E8S1A10 | 4.02 | 1.04 | 2.67 | 121.6 | 4.45 |
| | 3.93 | 0.84 | 2.54 | 119.0 | 2.96 |
| | 4.02 | 0.77 | 2.51 | 117.1 | 2.53 |
| PC7E8S1A11 | 1.72 | 0.58 | 1.08 | 119.7 | 1.41 |
| | 2.65 | 0.94 | 1.41 | 104.4 | 4.23 |
| | 2.10 | 0.97 | 1.34 | 111.6 | 4.22 |
| PC7E8S1A12 | The ribbon is broken when clamped, too brittle for testing | | | | |
| PC7E8S1A13 | 4.39 | 0.59 | 2.59 | 121.1 | 1.44 |
| | 3.95 | 1.21 | 2.42 | 121.9 | 6.00 |
| | 4.69 | 0.82 | 2.42 | 97.2 | 3.46 |
| PC7E8S1A14 | 4.94 | 0.97 | 2.40 | 107.1 | 4.39 |
| | 3.38 | 0.75 | 1.91 | 113.4 | 2.48 |
| | 5.66 | 1.23 | 2.31 | 82.4 | 9.18 |
| PC7E8S1A15 | 2.16 | 0.96 | 1.26 | 109.4 | 4.21 |
| | 2.60 | 1.14 | 1.39 | 105.8 | 6.14 |
| | 2.08 | 1.33 | 1.36 | 131.4 | 6.73 |
| PC7E8S1A16 | The ribbon is broken when clamped, too brittle for testing | | | | |
| PC7E8S8A1 | 5.70 | 0.93 | 2.47 | 104.8 | 4.13 |
| | 3.93 | 0.80 | 2.11 | 112.5 | 2.84 |
| | 5.67 | 0.66 | 2.15 | 86.0 | 2.53 |
| PC7E8S8A2 | 4.77 | 0.75 | 2.35 | 109.8 | 2.56 |
| | 5.66 | 0.98 | 2.83 | 113.8 | 4.22 |
| | 4.57 | 1.16 | 2.52 | 100.0 | 6.73 |
| PC7E8S8A3 | 3.05 | 1.20 | 1.80 | 106.6 | 6.75 |
| | 4.41 | 1.16 | 2.21 | 92.7 | 7.26 |
| | 3.06 | 1.14 | 1.81 | 105.7 | 6.15 |
| PC7E8S8A4 | 2.61 | 0.87 | 1.37 | 96.8 | 3.91 |
| | 2.56 | 0.96 | 1.51 | 105.8 | 4.36 |
| | 2.59 | 0.86 | 1.37 | 93.2 | 3.97 |
| PC7E8S8A5 | 5.29 | 0.69 | 2.58 | 112.9 | 2.11 |
| | 5.24 | 1.18 | 2.47 | 100.0 | 6.96 |
| | 5.94 | 1.02 | 2.63 | 96.8 | 5.37 |

TABLE 7-continued

Summary of Tensile Test Results at 10.5 m/s

| Alloy | Total Elongation (%) | Yield Strength (GPa) | UTS (GPa) | Young's Modulus (GPa) | Modulus of Resilience (MPa) |
|---|---|---|---|---|---|
| PC7E8S8A6 | 5.96 | 1.16 | 2.93 | 104.8 | 6.42 |
| | 4.65 | 1.12 | 2.52 | 105.8 | 5.93 |
| | 4.31 | 1.73 | 3.32 | 157.4 | 9.51 |
| PC7E8S8A7 | 2.58 | 0.58 | 2.09 | 148.5 | 1.13 |
| | 5.04 | 1.06 | 2.98 | 121.5 | 4.62 |
| | 4.45 | 1.03 | 2.75 | 123.3 | 4.30 |
| PC7E8S8A8 | 6.80 | 0.63 | 2.69 | 118.8 | 1.67 |
| | 5.17 | 0.56 | 2.12 | 104.4 | 1.50 |
| | 4.92 | 0.72 | 3.45 | 149.3 | 1.74 |
| PC7E8S8A6X1 | 4.87 | 1.04 | 3.05 | 124.0 | 4.36 |
| | 4.33 | 0.82 | 2.95 | 144.6 | 2.33 |
| | 4.26 | 0.82 | 2.92 | 115.4 | 2.91 |
| PC7E8S8A6X2 | 4.45 | 1.01 | 2.79 | 132.2 | 3.86 |
| | 4.77 | 0.94 | 2.83 | 120.2 | 3.68 |
| | 4.21 | 1.05 | 3.03 | 125.2 | 4.40 |
| PC7E8S8A6X3 | 4.07 | 0.9 | 2.98 | 148.4 | 2.73 |
| | 3.71 | 0.82 | 2.76 | 139.6 | 2.41 |
| | 4.33 | 0.92 | 2.89 | 147.9 | 2.86 |
| PC7E9S1A1X1 | 4.67 | 1.05 | 2.72 | 114.5 | 4.81 |
| | 4.77 | 1.65 | 3.21 | 142.0 | 9.59 |
| | 2.72 | 1.36 | 2.27 | 164.2 | 5.63 |
| PC7E9S1A1X2 | 4.51 | 1.34 | 3.21 | 146.4 | 6.13 |
| | 4.27 | 0.97 | 3.15 | 152.3 | 3.09 |
| | 3.84 | 1.98 | 3.30 | 172.0 | 11.40 |
| PC7E9S1A1X3 | 5.58 | 0.81 | 2.64 | 105.8 | 3.10 |
| | 4.77 | 0.95 | 2.36 | 110.7 | 4.08 |
| | 4.45 | 1.06 | 2.35 | 117.8 | 4.77 |
| PC7E9S1A1X4 | 4.59 | 1.07 | 2.93 | 123.6 | 4.63 |
| | 4.62 | 0.67 | 2.91 | 134.5 | 1.67 |
| | 4.25 | 0.75 | 3.34 | 153.2 | 1.84 |
| PC7E9S1A1X5 | 4.64 | 0.97 | 3.19 | 151.5 | 3.11 |
| | 5.66 | 1.30 | 3.70 | 129.2 | 6.54 |
| | 4.31 | 0.71 | 2.76 | 122.7 | 2.05 |
| PC7E9S1A1X6 | 4.07 | 0.61 | 3.17 | 152.7 | 1.22 |
| | 5.11 | 0.88 | 2.97 | 128.4 | 3.02 |
| | 3.82 | 0.35 | 2.90 | 149.9 | 0.41 |
| PC7E9S1A1X7 | 4.46 | 0.51 | 3.09 | 140.6 | 0.92 |
| | 5.17 | 0.51 | 2.80 | 133.7 | 0.97 |
| | 3.87 | 1.16 | 3.16 | 156.1 | 4.31 |
| PC7E9S1A1X8 | 4.65 | 0.92 | 3.07 | 131.8 | 3.21 |
| | 3.87 | 0.95 | 3.12 | 154.2 | 2.93 |
| | 4.30 | 0.58 | 3.13 | 162.7 | 1.03 |
| PC7E9S1A1X9 | 5.36 | 0.89 | 2.93 | 133.5 | 2.97 |
| | 4.28 | 0.65 | 2.75 | 141.6 | 1.49 |
| | 3.87 | 1.09 | 3.17 | 156.2 | 3.80 |
| PC7E9S1A1X10 | 3.89 | 0.56 | 2.52 | 152.3 | 1.03 |
| | 3.91 | 0.54 | 2.67 | 156.0 | 0.93 |
| | 3.66 | 1.28 | 3.07 | 161.1 | 5.09 |
| PC7E9S1A1X11 | 4.05 | 0.67 | 2.38 | 111.9 | 2.01 |
| | 3.97 | 0.65 | 2.66 | 118.8 | 1.78 |
| | 2.98 | 0.89 | 2.39 | 128.5 | 3.08 |
| PC7E9S1A1X12 | 4.35 | 0.76 | 2.85 | 127.2 | 2.27 |
| | 4.33 | 0.68 | 2.58 | 118.2 | 1.96 |
| | 4.60 | 0.71 | 2.67 | 113.2 | 2.23 |
| PC7E8S2A1 | The ribbon is broken when clamped, too brittle for testing | | | | |
| PC7E8S2A2 | 4.81 | 1.29 | 2.77 | 122.8 | 6.78 |
| | 3.00 | 1.03 | 1.86 | 123.3 | 4.30 |
| | 4.09 | 0.92 | 2.35 | 113.8 | 3.72 |
| PC7E8S2A3 | The ribbon is broken when clamped, too brittle for testing | | | | |
| PC7E8S2A4 | The ribbon is broken when clamped, too brittle for testing | | | | |
| PC7E8S3A1 | The ribbon is broken when clamped, too brittle for testing | | | | |
| PC7E8S3A2 | 2.67 | 0.74 | 1.92 | 134.3 | 2.04 |
| | 2.80 | 0.65 | 1.74 | 115.8 | 1.82 |
| | 2.63 | 0.47 | 1.43 | 112.7 | 0.98 |
| PC7E8S3A3 | 2.71 | 0.61 | 1.77 | 125.8 | 1.48 |
| | 2.54 | 0.65 | 1.68 | 116.6 | 1.81 |
| | 3.10 | 0.67 | 2.18 | 138.4 | 1.62 |
| PC7E8S3A4 | 2.92 | 1.26 | 1.97 | 126.8 | 6.26 |
| | 3.57 | 0.81 | 2.85 | 139.4 | 2.35 |
| | 2.84 | 0.57 | 2.22 | 168.3 | 0.97 |

TABLE 7-continued

Summary of Tensile Test Results at 10.5 m/s

| Alloy | Total Elongation (%) | Yield Strength (GPa) | UTS (GPa) | Young's Modulus (GPa) | Modulus of Resilience (MPa) |
|---|---|---|---|---|---|
| PC7E8S4A1 | 5.48 | 0.56 | 2.94 | 131.0 | 1.20 |
| | 6.00 | 0.70 | 2.3 | 105.8 | 2.32 |
| | 5.08 | 0.90 | 2.34 | 108.0 | 3.75 |
| PC7E8S4A2 | The ribbon is broken when clamped, too brittle for testing | | | | |
| PC7E8S4A3 | The ribbon is broken when clamped, too brittle for testing | | | | |
| PC7E8S4A4 | The ribbon is broken when clamped, too brittle for testing | | | | |
| PC7E8S6A1 | The ribbon is broken when clamped, too brittle for testing | | | | |
| PC7E8S6A2 | The ribbon is broken when clamped, too brittle for testing | | | | |
| PC7E8S6A3 | The ribbon is broken when clamped, too brittle for testing | | | | |
| PC7E8S6A4 | The ribbon is broken when clamped, too brittle for testing | | | | |
| PC7E8S6A5 | The ribbon is broken when clamped, too brittle for testing | | | | |
| PC7E8S7A1 | The ribbon is broken when clamped, too brittle for testing | | | | |
| PC7E8S7A2 | The ribbon is broken when clamped, too brittle for testing | | | | |
| PC7E8S7A3 | The ribbon is broken when clamped, too brittle for testing | | | | |
| PC7E8S7A4 | The ribbon is broken when clamped, too brittle for testing | | | | |
| PC7E9S1A1 | 3.56 | 0.83 | 2.22 | 119.5 | 2.88 |
| | 3.52 | 0.68 | 2.02 | 110.7 | 2.09 |
| | 3.98 | 1.04 | 2.03 | 101.8 | 5.31 |
| PC7E9S1A2 | 4.87 | 0.73 | 2.97 | 125.6 | 2.12 |
| | 2.90 | 1.82 | 2.01 | 113.2 | 14.62 |
| | 4.18 | 0.67 | 2.53 | 110.5 | 2.03 |
| PC7E9S1A3 | 4.68 | 0.89 | 2.80 | 137.2 | 2.88 |
| | 3.92 | 0.71 | 2.43 | 127.7 | 1.97 |
| | 4.33 | 1.06 | 3.14 | 141.3 | 3.97 |
| PC7E9S1A4 | 3.89 | 0.67 | 2.57 | 134.6 | 1.66 |
| | 3.60 | 0.61 | 2.45 | 137.5 | 1.35 |
| | 3.92 | 0.70 | 2.45 | 129.0 | 1.90 |
| PC7E9S1A5 | 2.43 | 0.51 | 2.20 | 159.5 | 0.81 |
| | 2.89 | 0.69 | 2.40 | 142.8 | 1.67 |
| | 3.83 | 0.85 | 2.79 | 138.7 | 2.60 |

Figure 9:
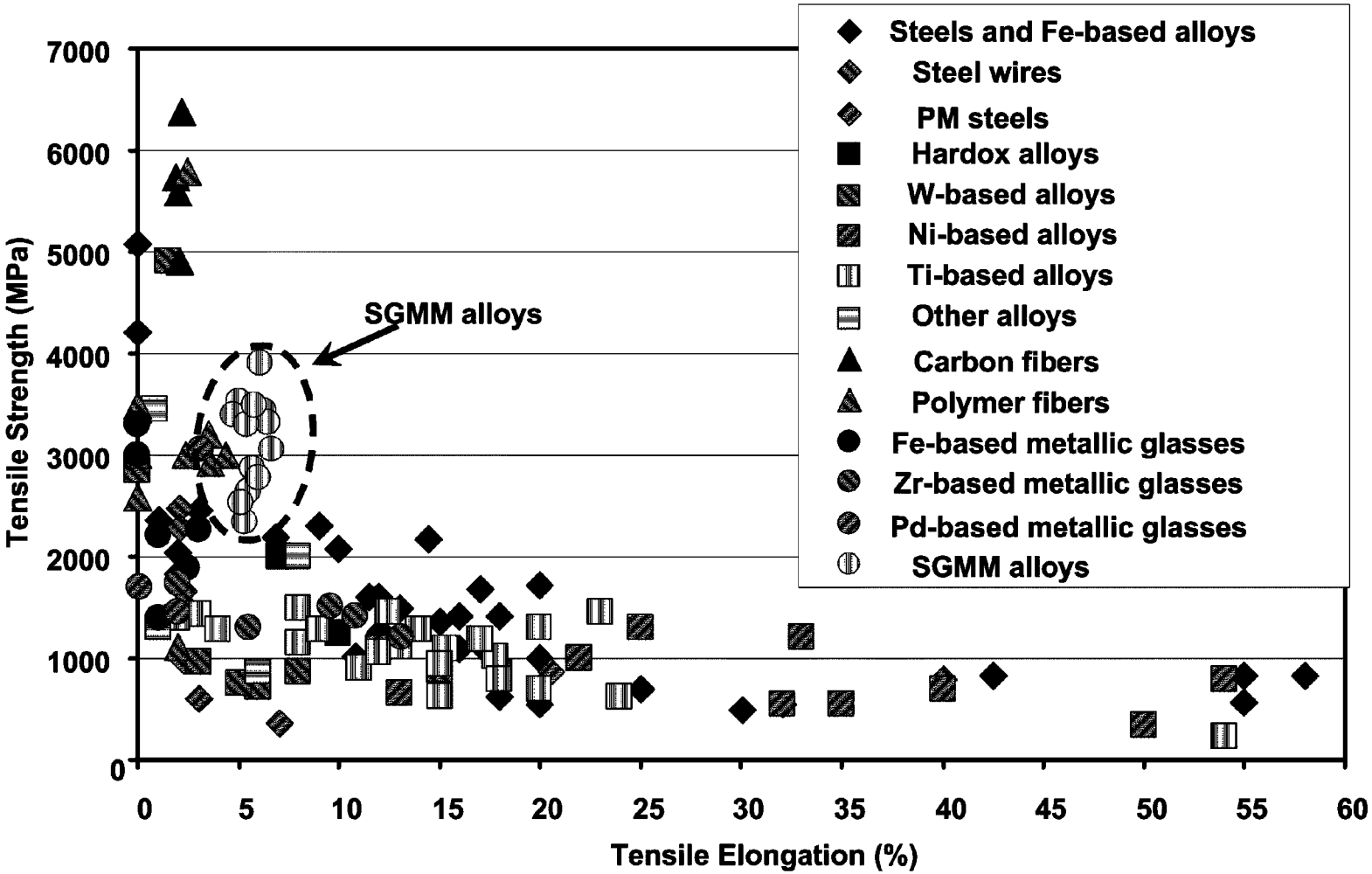
FIG. 9 provides a summary of tensile strength vs tensile elongation for a wide variety of material classes including the best new data from the SGMM alloys.

FIG. 9, presents a summary of literature data illustrating the combination of tensile strength and tensile elongation found in examplary material classes. As shown, with increases in tensile strength, tensile elongation decreases and with increases in tensile elongation, tensile strength decreases. This may be because in conventional materials, at room temperature, deformation may occur mainly by the motion of dislocations, while increases in strength may occur mainly by the inhibition of dislocation motion, which may be achieved by introducing/engineering defects into the material in a controllable manner.

Not to be limited to any certain theory, the following is a potential mechanism which may explain the observed behavior of tensile elongation (>1%, including all values and increments in the range of 1% to 7%) in the measured SGMM samples. In metallic glasses, plastic deformation may be relatively inhomogeneous at room temperature and may take place in thin bands of shear which are sometimes called shear transformation zones. Due to the concentration of relatively high stress in narrow bands and the tendency for shear bands to exhibit catastrophic failure, the total global plasticity in metallic glasses may be relatively low. Two main factors, shear band nucleation and shear band propagation, may need to be concurrently optimized in order to increase global plasticity. By reducing the nucleation energy barrier for shear bands, the nucleation of shear bands may be easier. Through raising the energy barrier for propagation, it may make it more difficult for the shear band to propagate and promote blunting, branching, and multiplication.

Again, not to be limited by any theory, the combination of the experimental and theoretical data suggests that the following potential deformation mechanism is occurring. It is not known specifically how the nucleation barrier is changing as a result of the various alloys since the specific shear band density has not been well studied. However, it is possible that chemistry changes may cause a change in the nature of the molecular associations, an alteration of their packing, and a change in free volume. This in turn may alter the specific defect sites which can promote nucleation of new shear bands and contribute to increased global plasticity. Currently, the existing materials may be reaching an upper bound or an exhaustion of shear band nucleation sites.

It is believed that there is evidence at this time that the new alloys have an ability to reduce shear band propagation through the achievement of a new type of nanoscale structure which is called a Spinodal Glass Matrix Microconstituent (SGMM). Shear deformation is understood to require dilation and necessitate the creation of free volume. Free volume may promote a local decrease in viscosity which may lead to strain softening and catastrophic failure. The mechanism is called Induced Shear Band Blunting (ISBB) which may be enabled by localized deformation induced changes (LDIC). The LDIC represents three main types of concurrent changes that may ensure ISBB. The first type of LDIC is understood to include phase growth of the existing nanoparticulate phases. The phase growth may result in a reduction of the total phase boundary area and may result in an increase in total density, thus reducing the total available free volume. The second type of LDIC called in-situ nanocrystallization is understood to arises from the localized temperature rises found at high loading. Higher fraction of crystals in the glass matrix may increase viscosity and may compensate for strain softening and runaway shear propagation. The third type of LDIC is related to a believed phase change which may act to reduce the free volume which may be created in the shear band. The expected spinodal phases which may be formed are believed to be close packed crystal structures (i.e. FCC/HCP). Upon interaction of the stress, stress induced changes are expected to change the close packed structure to non-close packed (i.e. BCC) crystal structures. Thus, to effectively prevent work softening by increasing viscosity, the LDIC leading to a high density of nanoparticulates with a uniform distribution may be relatively effective.

Relatively high bend ductility and relatively significant elongation may be maintained in the alloys exhibiting the SGMM structure in thickness from 0.015 to 0.12 mm with high cooling rates from ~$10^4$ to ~$10^6$ K/s. In Table 8, the material form, thickness and cooling rate summaries are shown as a comparison for the SGMM alloys and what understood to be examples of what may be currently produced by existing manufacturing processes. The details of the commercial manufacturing processes are described below. As shown, the thickness where ductility has been observed in the SGMM alloys of Table 2 and 3 are in the range of thicknesses produced by the listed commercial processing techniques. The cooling rates which lead to specific structures and resulting properties are in the range as well.

TABLE 8

Summary of Existing Commercial Processing Approaches

| Process | Material Form | Typical Thickness | Cooling Rate |
|---|---|---|---|
| Melt-Spinning of SGMM Alloys | Ribbon | 0.015 to 0.12 mm* | ~$10^4$ to ~$10^6$ K/s |
| Melt-Spinning/Jet Casting Commercial Process | Ribbon | 0.02 to 0.07 mm | ~$10^4$ to ~$10^6$ K/s |
| Wire casting process | Circular cross section wire | 0.3 to 0.15 mm | ~$10^5$ to ~$10^6$ K/s |
| Taylor-Ulitovsky Wire Casting Process | Round wire | 0.02 to 0.10 mm | ~$10^3$ to ~$10^6$ K/s |
| Planar Flow Casting Sheet Process | Thin sheet/foil | 0.02 to 0.08 mm | ~$10^4$ to ~$10^6$ K/s |

*Range of thickness where ductile response has been demonstrated

Figure 10:
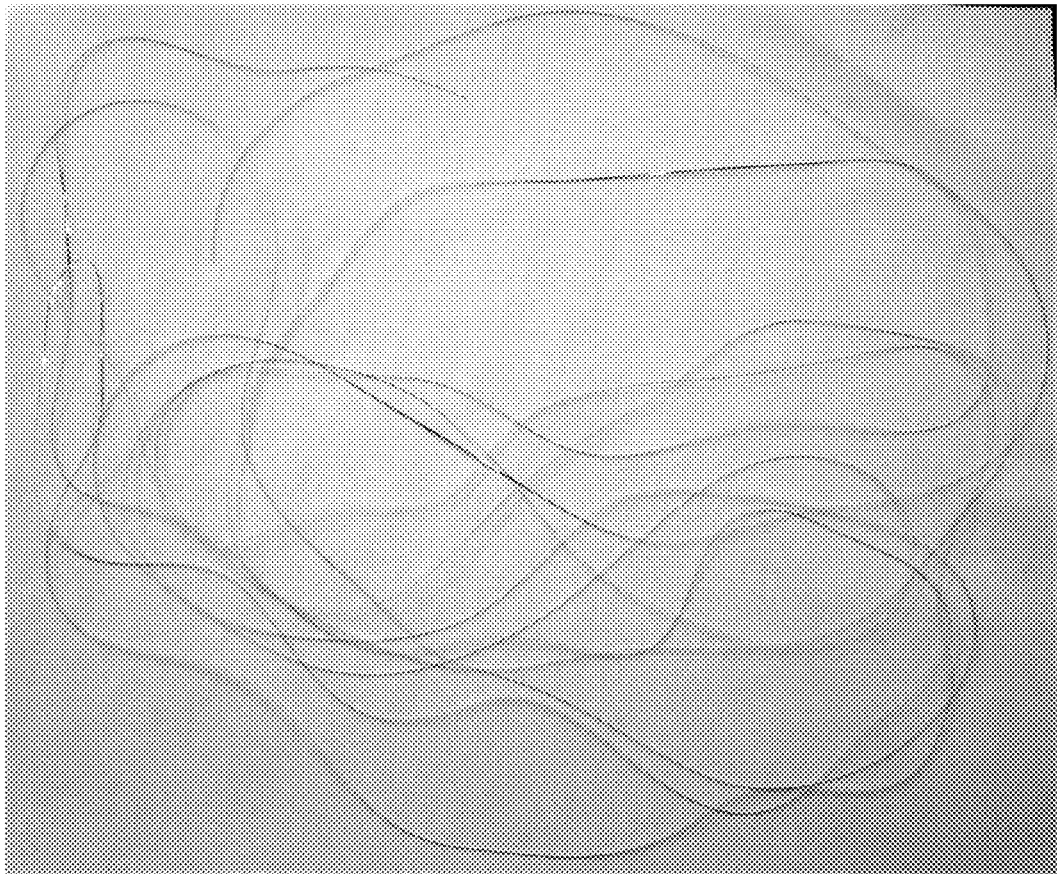
FIG. 10 illustrates an example of a melt-spun run which was produced at 10.5 m/s and is essentially one long ribbon.

It may be understood herein that in the melt-spinning process, a liquid melt may be ejected using gas pressure onto a rapidly moving copper wheel. Continuous or broken up lengths of ribbon are produced which are typically 1 to 2 mm wide and 0.015 to 0.15 mm thick, which depends on the melt spun materials viscosity and surface tension and the wheel tangential velocity. For the SGMM alloys, ribbons may generally be produced in a continuous fashion up to 25 m long using a laboratory scale system (FIG. 10). Existing commercial systems used for magnetic materials may be known as jet casters. Commercial jet casting systems are known to be operated by Magnequench International in SE Asia and by Saint-Gobain in France.

The wire casting process may be understood herein as a modified melt-spinning whereby liquid melt is ejected not onto a copper wheel but instead into a rotating liquid quenchant. The resulting product is a continuous wire with a circular cross section which is typically produced with a diameter of 0.1 to 0.15 mm. Various research systems are available including one sold by Phoenix Sci A process for producing small diameter wire with a circular cross section is called the Taylor-Ulitovsky process. It may be understood herein that in this wire making process, metal feedstock in the form of a powder, ingot, or wire/ribbon is held in a glass tube, typically a borosilicate composition, which is closed at one end. This end of the tube is then heated in order to soften the glass to a temperature at which the metal part is in liquid state while the glass is softened yet not melted. The glass containing the liquid melt can be then drawn down to produce a fine glass capillary containing a metal core. At suitable drawing conditions, the molten metal fills the glass capillary and a microwire is produced where the metal core is coated by a glass shell. During the last years the process has been converted to continuous one by continuously feeding the metal drop using powder or wire/ribbon with material.

The amount of glass used in the Taylor-Ulitovsky process may be balanced by the continuous feeding of the glass tube through the inductor zone, whereas the formation of the metallic core may be restricted by the initial quantity of the master alloy droplet. The microstructure of a microwire (and hence, its properties) depends mainly on the cooling rate, which can be controlled by a cooling mechanism when the metal-filled capillary enters into a stream of cooling liquid (water or oil) on its way to the receiving coil. Relatively high cooling rates from $10^4$ to $10^6$ K/s can be obtained in the process. Metal cores in the range of 1 to 120 μm with a glass coating which is typically from 2 to 20 μm in thickness can be produced by this method. The glass coating can be removed mechanically or by chemical methods such as dissolving in acid.

The planar flow casting may be understood herein as a technique to produce wide ribbon in the form of continuous sheet. Widths of sheet up to 18.4" (215 mm) may be produced on a commercial basis with thickness typically 0.016 to 0.075 mm thick. After production of sheets, the individual sheets can be warm pressed to roll bond the compacts into sheet. The technique may bond 5 to 20 individual sheets together but bonding over 50 sheets together is feasible.

Due to the combinations of favorable properties, which includes the high tensile strength and significant tensile elongation, it is probable that fibers, ribbons, weaves, foils, or combinations thereof would be able to provide significant ballistic protection for personnel and vehicles including face-masks, vests, and other items as clothing as well as stand alone armor panels and weaves to protect high value targets. Ribbons, fiber and wire forms will be able to be manufactured by weaving or other techniques to produce, wire ropes, cordage, screens, and weaved fabrics. Wires and cordage may be able to be used for wrapping to improve structural integrity of large towers or tanks, reinforcements in rubber such as tires, fishing line which may not require lead based sinkers, and as suspension for bridges, cranes or other lifting or holding devices. Due to the specific combination of favorable properties which includes very high tensile strength and significant tensile elongation, the fibers, wires, or wire forms are expected to be useful as replacements for existing metallic, glass or carbon based products for structural reinforcement in a variety of applications including helicopter or wind turbine blades. Additionally, there is the potential to add these thin product forms such as fiber, wire, or ribbon segments to infrastructure including asphalt and concrete, automobile parts such as brake pads and everyday consumer products including structural products manufactured through the pultrusion process.

Case Examples

Case Example #1

Using high purity elements (i.e., having a purity of 98 atomic percent or greater), 15 g alloy feedstocks of the PC7E8S1A9 alloy were weighed out according to the atomic ratio's provided in Table 2. Note depending on the exact high purity feedstock source, carbon impurities may be present. In the PC7E8S1A9, carbon impurity levels are estimated to be in the range of 0.1 to 0.25 atomic % carbon. The feedstock material was then placed into the copper hearth of an arc-melting system. The feedstock was arc-melted into an ingot using high purity argon (i.e., having a purity of 98 atomic percent or greater) as a shielding gas. The ingots were flipped several times and re-melted to ensure homogeneity. After mixing, the ingots were then cast in the form of a finger approximately 12 mm wide by 30 mm long and 8 mm thick. The resulting fingers were then placed in a melt-spinning chamber in a quartz crucible with a hole diameter of ~0.81 mm. The ingots were melted in a ⅓ atm helium atmosphere using RF induction and then ejected onto a 245 mm diameter copper wheel which was traveling at tangential velocities of 39, 30, 16, 10.5, 7.5 and 5 m/s.

Figure 11:
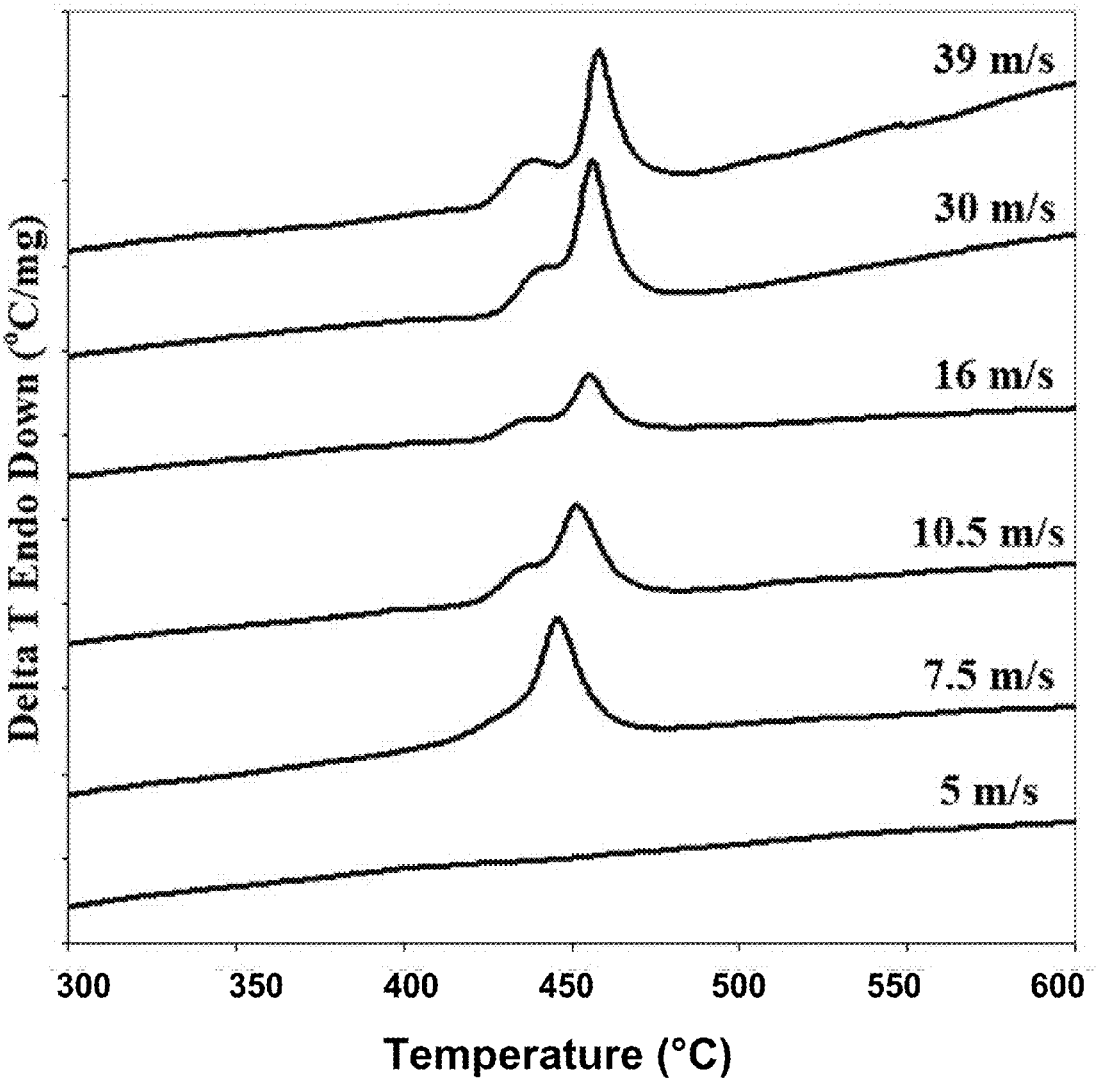
FIG. 11 illustrates DTA curves of the PC7E8S1A9 alloy melt-spun at 39, 30, 16, 10.5, 7.5 and 5 m/s.

Thermal analysis was performed on the as-solidified ribbons using a Perkin Elmer DTA-7 system with the DSC-7 option. Differential thermal analysis (DTA) and differential scanning calorimetry (DSC) was performed at a heating rate of 10° C./minute with samples protected from oxidation through the use of flowing ultrahigh purity argon. In Table 9, the DSC data related to the glass to crystalline transformation is shown for the PC7E9S1A9 alloy that was melt-spun at the different wheel tangential velocities from 39 m/s to 5 m/s. Note that the cooling rate increases at increasing wheel tangential velocities and the cooling rates are expected to be in the range of $10^6$ K/s at the highest wheel speed down to $10^3$ K/s at the lowest wheel speed. In FIG. 11, the DTA plots are shown for each sample as a function of wheel tangential velocity. As can be seen, the majority of samples (except that produced at 5 m/s) exhibit glass to crystalline transformations verifying that the as-spun state contains significant fractions of metallic glass. The glass to crystalline transformation occurs in either one stage or two stages in the range of temperature from 418 to 470° C. and with enthalpies of transformation from 60 to 140 J/g.

TABLE 9

DSC Data for Glass To Crystalline Transformations for PC7E8S1A9 Alloy

| | | Peak #1 | | | Peak #2 | | |
|---|---|---|---|---|---|---|---|
| Wheel Speed (m/s) | Glass | Onset (° C.) | Peak (° C.) | ΔH (-J/g) | Onset (° C.) | Peak (° C.) | ΔH (-J/g) |
| 39 | Yes | 427 | 436 | 25.0 | 451 | 458 | 110.7 |
| 30 | Yes | 432 | 448 | 15.5 | 448 | 456 | 107.5 |
| 16 | Yes | 427 | 434 | 9 | 445 | 455 | 51 |
| 10.5 | Yes | 427 | 434 | 10 | 440 | 451 | 85.4 |
| 7.5 | Yes | 418 | 428 | 20 | 435 | 446 | 105.7 |
| 5 | No | — | — | — | — | — | — |

In Table 10, elevated temperature DTA results are shown indicating the melting behavior for the PC7E8S1A9 alloy. As can be seen from the tabulated results in Table 10, the melting occurs in 1 to 2 stages with initial melting (i.e. solidus) observed from ~1086° C. to ~1094° C. with final melting up to ~1120° C.

TABLE 10

Differential Thermal Analysis Data for Melting Behavior for the PC7E8S1A9 Alloy Wheel

| Speed (m/s) | Peak #1 Onset (° C.) | Peak #1 Peak (° C.) | Peak #2 Onset (° C.) | Peak #2 Peak (° C.) |
|---|---|---|---|---|
| 39 | 1093 | 1112 | | |
| 30 | 1094 | 1111.6 | | |
| 16 | 1092 | 1110.5 | | |
| 10.5 | 1092 | 1114 | | |
| 7.5 | 1093 | 1104.8 | 1114.8 | 1120 |
| 5 | 1086 | 1116.9 | | |

Bending testing (180°) of the as-spun PC7E8S1A9 ribbon samples were done on each sample and the results were correlated in Table 11. As shown, depending on the alloy when processed on the particular conditions listed, the bending response was found to vary.

TABLE 11

Ribbon Thickness, Bending Response and Behavior Type for the PC7E8S1A9 Alloy

| Wheel Speed (m/s) | Ribbon Thickness (mm) | Bending Response | Behavior Type |
|---|---|---|---|
| 39 | 20-25 | Bendable on both sides | Type 4 |
| 30 | 30-40 | Bendable on both sides | Type 4 |
| 16 | 60 | Bendable on both sides | Type 4 |
| 10.5 | 70-80 | Bendable on both sides | Type 4 |
| 7.5 | 120 | Not bendable without breaking | Type 1 |
| 5 | 180-250 | Not bendable without breaking | Type 1 |

In Table 12, a summary of the tensile test results including total elongation, yield strength, ultimate tensile strength, Young's Modulus, Modulus of Resilience, and Modulus of Toughness are shown for the PC7E8S1A9 alloy when melt-spun at wheel tangential velocity from 39 to 5 m/s. Note that each distinct sample was measured in triplicate since occasional macrodefects arising from the melt-spinning process can lead to localized stresses reducing properties. As can be seen, all characteristics vary depending on ribbon thickness. Maximum tensile strength value of 3.48 GPa were measured for ribbons produced at wheel speed of 39 m/s. Young's modulus decreases with increasing ribbon thickness from 176 to 81 GPa. Yield stress was about 1.50-1.60 GPa for most of ribbons. All ribbon contained glass in as-produced state have shown total elongation in the range from 2.1 to 4.75%, modulus of resilience from 5.1 to 10.1 MPa, and modulus of toughness from 11 to 110 MPa.

TABLE 12

Summary of Tensile Test Results at 10.5 m/s for the PC7E8S1A9 Alloy

| Wheel Speed (m/s) | Total Elongation (%) | Yield Strength (GPa) | UTS (GPA) | Young's Modulus (GPa) | Modulus of Resilience (MPa) | Modulus of Toughness (MPa) |
|---|---|---|---|---|---|---|
| 39 | 2.78 | 1.63 | 2.2 | 175.95 | 7.55 | 24.5 |
| | 3.24 | 1.55 | 3.48 | 170.85 | 7.03 | 54.2 |
| | 3.14 | 1.45 | 2.95 | 169.15 | 6.20 | 50.2 |
| 30 | 3.9 | 1.38 | 2.76 | 137.02 | 6.90 | 59.4 |
| | 3.63 | 1.63 | 2.77 | 126.14 | 10.50 | 110 |
| | 3.13 | 1.52 | 2.73 | 145.35 | 7.90 | 43.2 |
| 16 | 3.46 | 1.61 | 2.54 | 128.86 | 10.00 | 47 |
| | 3.68 | 1.53 | 2.79 | 119 | 9.80 | 55.2 |
| | 4.3 | 1.55 | 2.99 | 120.19 | 10.00 | 65.8 |
| 10.5 | 4.75 | 1.50 | 2.99 | 118.32 | 9.50 | 74.4 |
| | 4.56 | 1.52 | 2.73 | 113.73 | 10.10 | 69.7 |
| | 4.6 | 1.51 | 2.93 | 112.2 | 10.10 | 68.5 |
| 7.5 | 2.1 | — | 1.14 | 87.21 | — | 11.6 |
| | 3.09 | 0.96 | 1.66 | 90.1 | 5.10 | 27.6 |
| | 4.13 | 0.97 | 1.9 | 86.87 | 5.40 | 43.8 |
| 5 | 1.0 | — | 0.52 | 81.77 | — | 0 |
| | 1.67 | — | 0.55 | 81.09 | — | 3.5 |

Case Example #2

Using high purity elements, 15 g alloy feedstocks of the PC7E9S1A1X6 alloy were weighed out according to the atomic ratio's provided in Table 2. The feedstock material was then placed into the copper hearth of an arc-melting system. The feedstock was arc-melted into an ingot using high purity argon as a shielding gas. The ingots were flipped several times and remelted to ensure homogeneity. After mixing, the ingots were then cast in the form of a finger approximately 12 mm wide by 30 mm long and 8 mm thick. The resulting fingers were then placed in a melt-spinning chamber in a quartz crucible with a hole diameter of ~0.81 mm. The ingots were melted in a ⅓ atm helium atmosphere using RF induction and then ejected onto a 245 mm diameter copper wheel which was traveling at tangential velocities of 10.5, 7.5 and 5 m/s.

Figure 12:
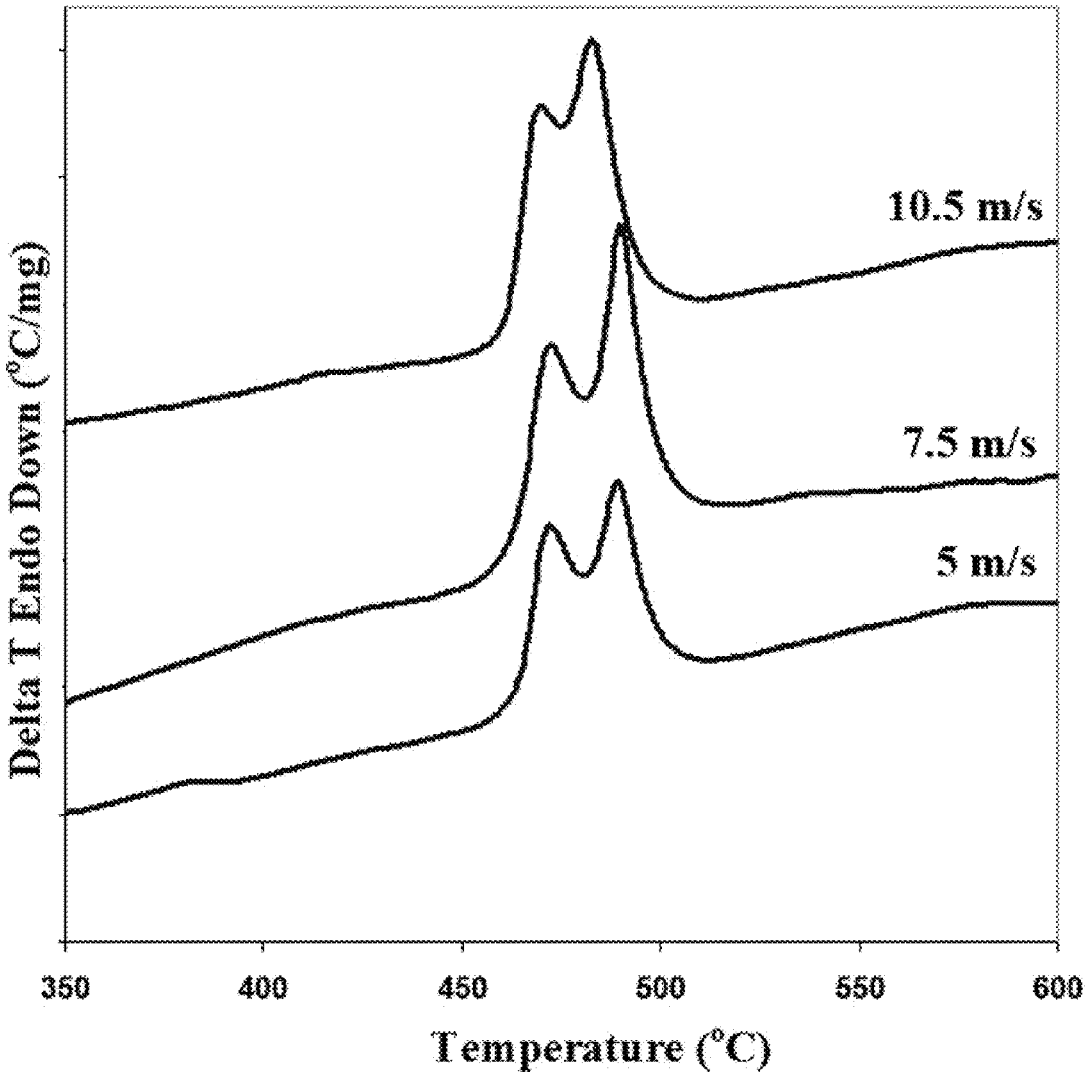
FIG. 12 illustrates DTA curves of the PC7E9S1A1X6 alloy melt-spun at 10.5, 7.5, and 5 m/s.

Thermal analysis was performed on the as-solidified ribbons using a Perkin Elmer DTA-7 system with the DSC-7 option. Differential thermal analysis (DTA) and differential scanning calorimetry (DSC) was performed at a heating rate of 10° C./minute with samples protected from oxidation through the use of flowing ultrahigh purity argon (i.e., having a purity of 99 atomic percent or greater). In Table 13, the DSC data related to the glass to crystalline transformation is shown for the PC7E9S1A1X6 alloy that was melt-spun at the different wheel tangential velocities from 39 m/s and 5 m/s. Note that the cooling rate increases at increasing wheel tangential velocities and the cooling rates are expected to be in the range of $10^6$ K/s at the highest wheel speed down to $10^3$ K/s at the lowest wheel speed. In FIG. 12, the DTA plots are shown for each sample as a function of wheel tangential velocity. As can be seen, all samples exhibit glass to crystalline transformations verifying that the as-spun state contains relatively significant fractions of metallic glass. The glass to crystalline transformation occurs in two stages in the range of temperature from 465 to 520° C. and with enthalpies of transformation from 44 to 147 J/g.

TABLE 13

DSC Data for Glass To Crystalline Transformations for PC7E9S1A1X6 Alloy

| | | Peak #1 | | | Peak #2 | | |
|---|---|---|---|---|---|---|---|
| Wheel Speed (m/s) | Glass | Onset (° C.) | Peak (° C.) | ΔH (-J/g) | Onset (° C.) | Peak (° C.) | ΔH (-J/g) |
| 10.5 | Yes | 465 | 472 | 18 | 483 | 490 | 26 |
| 7.5 | Yes | 465 | 471 | 65 | 480 | 490 | 82 |
| 5 | Yes | 465 | 471 | 40 | 482 | 489 | 57 |

In Table 14, elevated temperature DTA results are shown indicating the melting behavior for the PC7E9S1A1X6 alloy. As can be seen from the tabulated results in Table 14, the melting occurs in 1 stage with initial melting (i.e. solidus) observed from ~1069° C. to ~1073° C. with final melting up to ~1120° C.

TABLE 14

Differential Thermal Analysis Data for Melting Behavior for the PC7E9S1A1X6 Alloy Wheel

| Speed (m/s) | Peak #1 Onset (° C.) | Peak #1 Peak (° C.) |
|---|---|---|
| 10.5 | 1073 | 1097 |
| 7.5 | 1070 | 1094 |
| 5 | 1069 | 1091 |

Bending testing (180° of the as-spun PC7E9S1A1X6 ribbon samples were done on each sample and the results were correlated in Table 15. As shown, depending on the alloy when processed on the particular conditions listed, the bending response was found to vary.

TABLE 15

Ribbon Thickness, Bending Response and Behavior for the PC7E9S1A1X6 Alloy

| Wheel Speed (m/s) | Ribbon Thickness (mm) | Bending Response | Behavior Type |
|---|---|---|---|
| 10.5 | 0.07 | Bendable on both sides | Type 4 |
| 7.5 | 0.11 | Bendable on both sides | Type 4 |
| 5 | 0.14 | Not bendable without breaking | Type 1 |

In Table 16, a summary of the tensile test results including total elongation, yield strength, ultimate tensile strength, Young's Modulus, Modulus of Resilience, and Modulus of Toughness are shown for the PC7E9S1A1X6 alloy when melt-spun at wheel tangential velocity from 39 to 5 m/s. Note that each distinct sample was measured in triplicate since occasional macrodefects arising from the melt-spinning process can lead to localized stresses reducing properties. As can be seen most of characteristics vary depending on ribbon thickness. Maximum tensile strength value of 3.41 GPa were measured for ribbons produced at wheel speed of 10.5 m/s. Young's modulus decreases with increasing ribbon thickness from 136 to 87 GPa. Yield stress was measured in the range from 1.10 to 1.67 GPa. Most of ribbons have shown total elongation in the range from 3.54 to 5.95%, modulus of resilience from 8.53 to 14.92 MPa, and modulus of toughness from 33.6 to 91.3 MPa.

TABLE 16

Summary of Tensile Test Results for the PC7E9S1A1X6 Alloy

| Wheel Speed (m/s) | Total Elongation (%) | Yield Strength (GPa) | UTS (GPA) | Young's Modulus (GPa) | Modulus of Resilience (MPa) | Modulus of Toughness (MPa) |
|---|---|---|---|---|---|---|
| 10.5 | 4.58 | 1.52 | 3.10 | 103.3 | 11.12 | 90.0 |
| | 4.09 | 1.31 | 3.03 | 136.3 | 6.29 | 79.5 |
| | 3.41 | 1.47 | 3.41 | 115.9 | 9.32 | 91.3 |
| 7.5 | 5.95 | 1.60 | 2.44 | 103.5 | 12.39 | 83.3 |
| | 4.50 | 1.67 | 2.34 | 93.48 | 14.92 | 70.2 |
| | 4.68 | 1.37 | 2.43 | 97.41 | 9.63 | 60.7 |
| 5 | 4.47 | 1.24 | 2.27 | 90.1 | 8.53 | 56 |
| | 1.65 | 1.30 | 0.96 | 92.8 | 9.11 | 8.4 |
| | 3.54 | 1.10 | 1.81 | 87.2 | 18.78 | 33.6 |

Case Example #3

Using high purity elements, a 15 g alloy feedstock of the PC7E8S1A9 alloy was weighed out according to the atomic ratio's provided in Table 2. The feedstock material was then placed into the copper hearth of an arc-melting system. The feedstock was arc-melted into an ingot using high purity argon as a shielding gas. The ingot was flipped several times and remelted to ensure composition homogeneity. After mixing, the ingots were then cast in the form of a finger approximately 12 mm wide by 30 mm long and 8 mm thick. The resulting fingers were then placed in a melt-spinning chamber in a quartz crucible with a hole diameter of ~0.81 mm. The ingots were melted in a ⅓ atm helium atmosphere using RF induction and then ejected onto a 245 mm diameter copper wheel which was traveling at a tangential velocity of 10.5 m/s. The ribbon surface that was in contact with the copper wheel is referred as the wheel-side surface, while the other surface is referred as the free-side surface.

To examine the microstructures in the wheel side of the ribbon, segments of ~3 mm long were prepared. A thin layer of ~5 μm was first removed from the surface on the wheel side by mechanical polishing, followed by fine polishing using colloidal diamond suspensions with reducing particle sizes from 6 μm to 1 μm. Then, a thicker layer of ~55 μm was further removed from the free side of the ribbon, using the same procedure. To obtain electronic-transparent area for TEM observation, the resulting thin ribbon foil which was about 10 μm thick was ion milled using a Gatan Precision Ion Polishing System (PIPS) which was operated at an ion beam energy level of ~4 keV. The ion beam incident angle was 10° first, then reduced to 7° after penetration, and finished up by further reducing 4°. This ensures the thin areas to be large enough for TEM examination. To prepare TEM foils to examine the microstructures in the central region of the ribbon, a layer of ~30 μm thick was mechanically removed from each side by following the same mechanical thinning and polishing procedures.

Microstructures in the Wheel Side

Figure 13:
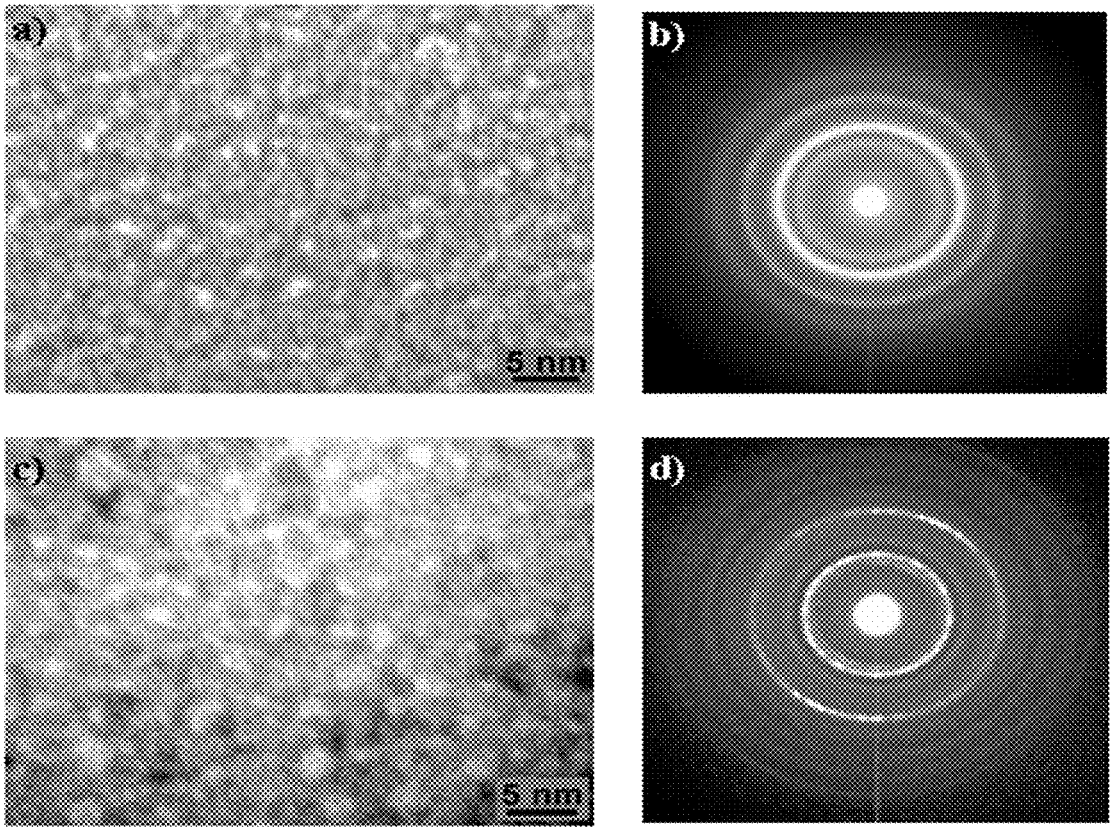
FIG. 13 illustrates TEM micrographs of the microstructures and SAED patterns for the PC7E8S1A9 ribbons; including the microstructure (FIG. 13*a*) and corresponding SAED pattern (FIG. 13*b*) for the wheel side, and microstructure (FIG. 13*c*) and the corresponding SAED pattern (FIG. 13*d*) for the central region.

The glass-matrix composite on the wheel side contains semicrystalline or crystalline nanoscale particles that are homogeneously distributed in the glass matrix which has been identified as the SGMM structure (see FIG. 13). The average particle size is ~2 nm, as shown in FIG. 13*a*. The corresponding selected area electron diffraction (SAED) patterns are shown in FIG. 13*b* and the ratio of the ring diameter squares, including that of the amorphous ring, is ~1.0:2.0:3.0:5.0. Such ratio value reveals that the nanoscale precipitates are possibly body-centered cubic (BCC) crystals, whose {200} diffraction ring has a similar diameter as the amorphous ring, and thus, may be overshadowed or the nanoscale precipitates are semicrystalline in nature and do not have well defined Bragg diffraction spots.

Microstructures in the Central Region

The central region of the ribbon also exhibits a SGMM structure containing homogeneously distributed nanocrystalline particles (NCPs) with uniform sizes (FIG. 13*c*). The crystalline phases are larger than those found in the wheel side and the corresponding SAED patterns, displayed in FIG. 13*d*, are clearly different. Two additional diffraction rings appear, while the amorphous rings become faint into background brightness. It should be noted that the electron diffraction spots correspond to phases which are not able to be identified at this times since spots did not correspond to high symmetry zone axes. The weak amorphous halo is also indicative of increases of crystalline volume fractions and a decrease in volume for amorphous phase. Such changes may be attributed to the decreasing cooling rates from the wheel-side surface to the ribbon center.

Case Example #4

Using high purity elements, a fifteen gram charge of the PC7E7 alloy was weighed out according to the atomic ratio's in Table 2. The mixture of elements was placed onto a copper hearth and arc-melted into an ingot using ultrahigh purity argon as a cover gas. After mixing, the resulting ingot was cast into a finger shape appropriate for melt-spinning. The cast fingers of PC7E7 were then placed into a quartz crucible with a hole diameter nominally at 0.81 mm. The ingots were heated up by RF induction and then ejected onto a rapidly moving 245 mm copper wheel traveling at a wheel tangential velocity of 10.5 m/s. In order to introduce shear bands into the ribbons, the as-cast PC7E7w10.5 ribbons were stretched in a micro-tensile testing stage. The ribbon tested was 1.33 mm wide and 0.07 mm thick and was stretched to fracture.

Figure 14:
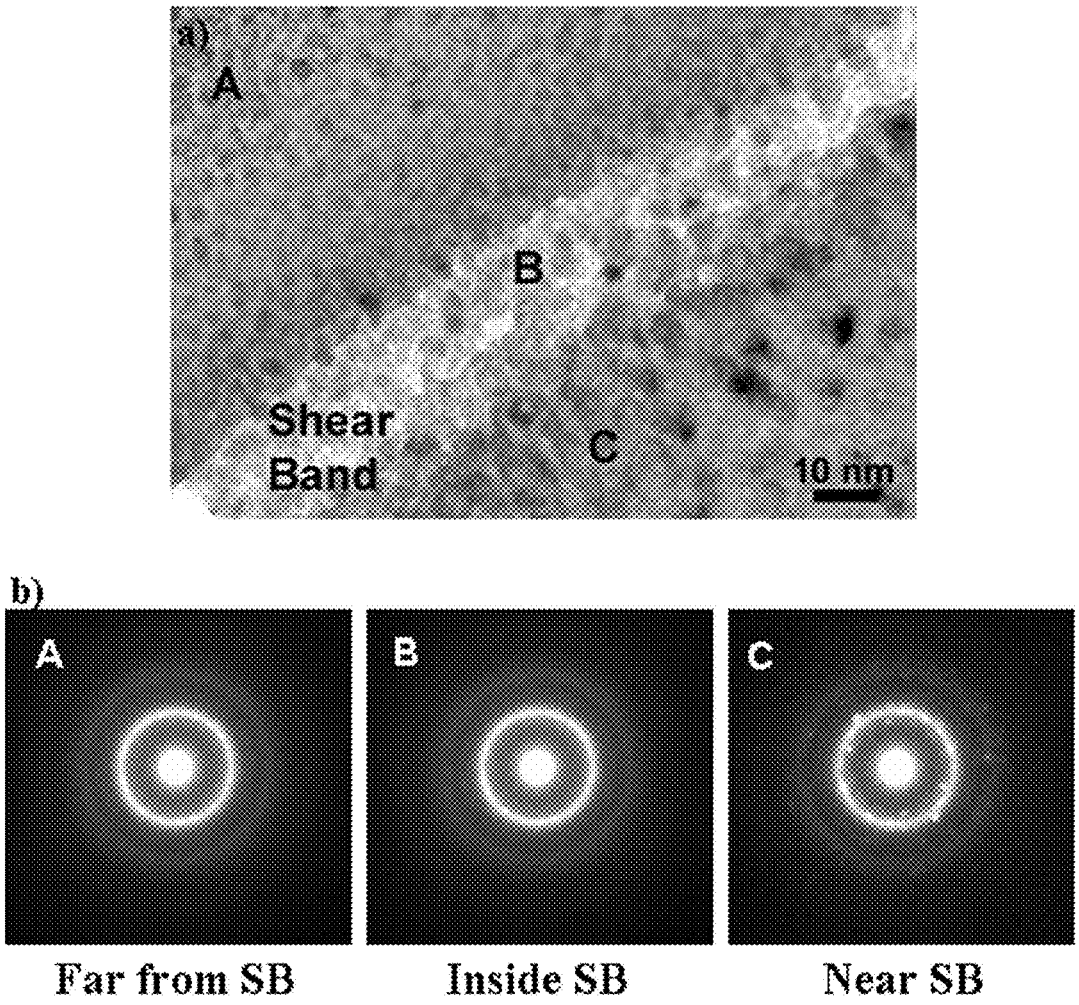
FIG. 14 illustrates TEM micrograph of the localized deformation induced changes (LDIC) around a shear band; wherein FIG. 14*a*) illustrates microstructure changes inside and around the shear band in areas A, B, and C, FIG. 14*b*) illustrates phase transformation revealed by the changes in the selected area electron diffraction (SAED) patterns in areas A, B, and C.

From the gauge length region which was ~3 mm long, segments were then cut and processed for TEM observation. TEM foils were prepared following the same procedures as described in Case Example #3. TEM foils were prepared from the regions close to the free-side surface. Shear bands of different thicknesses, ranging from ten to fifty nanometers, were observed. Generally, the shear bands are oriented in directions that are about 45 degree with respect to the stretching axis. The initial microstructure on the free side of the ribbons forms the identified SGMM microstructure, as shown in region A in FIG. 14*a*, which is far enough from the shear band so that the original microstructure remains unchanged. Inside the shear band, the nanocrystalline spinodal phases are found to grow slightly inside the shear band, identified as the B region in FIG. 14*a*. Additionally, the sizes of the nanocrystalline particles in the region C, which is next to the shear band, are greater than those inside the shear band. This suggests that the nanocrystalline particle growth may be induced by the localized deformation and the growth is found to be more significant in the region surrounding the shear band (region C) than inside the shear band (region B).

Figure 15:
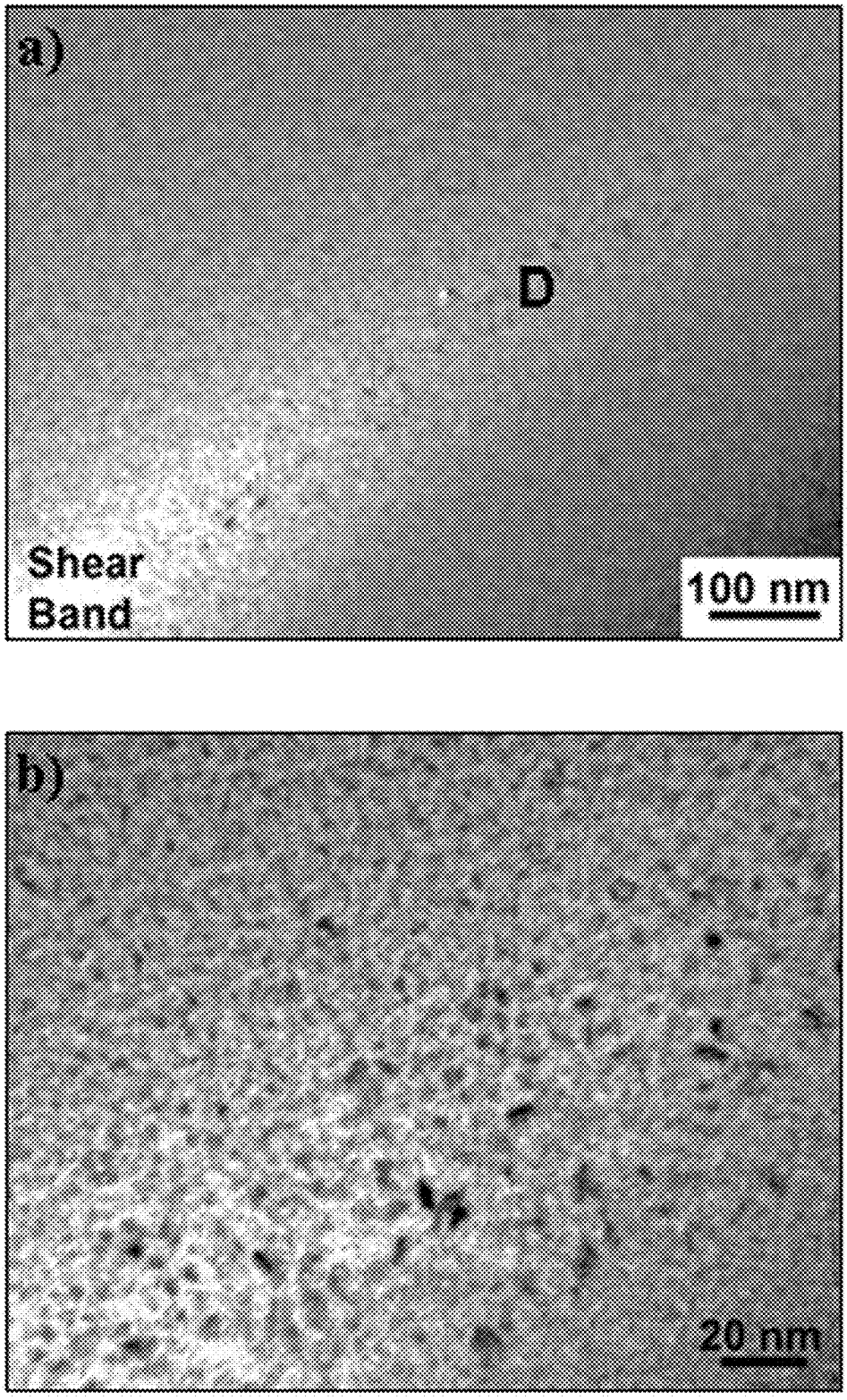
FIG. 15 illustrates localized shear deformation induced crystal growth in the region ahead of the growing shear band tip. The nanocrystalline particles with increased sizes are revealed in FIG. 15*b*) for the selected region D indicated in FIG. 15*a*) using a rectangle.

In addition to the significant crystal growth, new crystalline phase or phases are also formed, particularly in the region surrounding the shear band region (C). The phase transformation is revealed in FIG. 14*b* by the selected area electron diffraction (SAED) patterns, including both diffraction rings and diffraction spots. The SAED patterns A, B, and C respectively correspond to the three regions A, B, and C in FIG. 14*a*. In the unaffected region A, the nanocrystalline precipitates appear to be remain unchanged inside the shear band (region B), although the NCP sizes slightly increases. However, new phases are formed in the region around the shear band (region C), and clearly revealed by the additional diffraction rings, as well as diffraction spots. In particular, one additional diffraction ring has a diameter smaller than the amorphous halo, and many diffraction spots present around the amorphous halo. This confirms coincidence of diffraction ring from nanocrystalline particles with the amorphous halo as pointed out in Case Example #3. Such localized deformation induced crystal growing also occurs in the region ahead of the shear band tip, as shown in FIGS. 12*a* and 12*b*. FIG. 15*b* shows the NCPs with increased sizes in the selected rectangular region in FIG. 15*a*. Since the shear band is stopped here and the localized shear deformation is terminated right in this region, it is, therefore indicative of the physical mechanisms and process that block the runaway shear deformation and is a dynamic process. When shear occurs, the localized shear deformation induces crystal growth and phase transformation, which may reduce the magnitude of the local stress levels right ahead of the shear band, to stop itself from further propagation.

Case Example #5

Using high purity elements, 15 g alloy feedstocks of the PC7E7w16 and PC7E8S8A6w16 alloys were weighed out according to the atomic ratio's provided in Table 2 to study the fracture surfaces. The feedstock materials were then placed into the copper hearth of an arc-melting system. The feedstocks were arc-melted into ingots using high purity argon as a shielding gas. The ingots were flipped several times and remelted to ensure homogeneity. After mixing, the ingots were then cast in the form of a finger approximately 12 mm wide by 30 mm long and 8 mm thick. The resulting fingers were then placed in a melt-spinning chamber in a quartz crucible with a hole diameter of ~0.81 mm. The ingots were melted in a ⅓ atm helium atmosphere using RF induction and then ejected onto a 245 mm diameter copper wheel which was traveling at a tangential velocities of 16 m/s.

Figure 16:
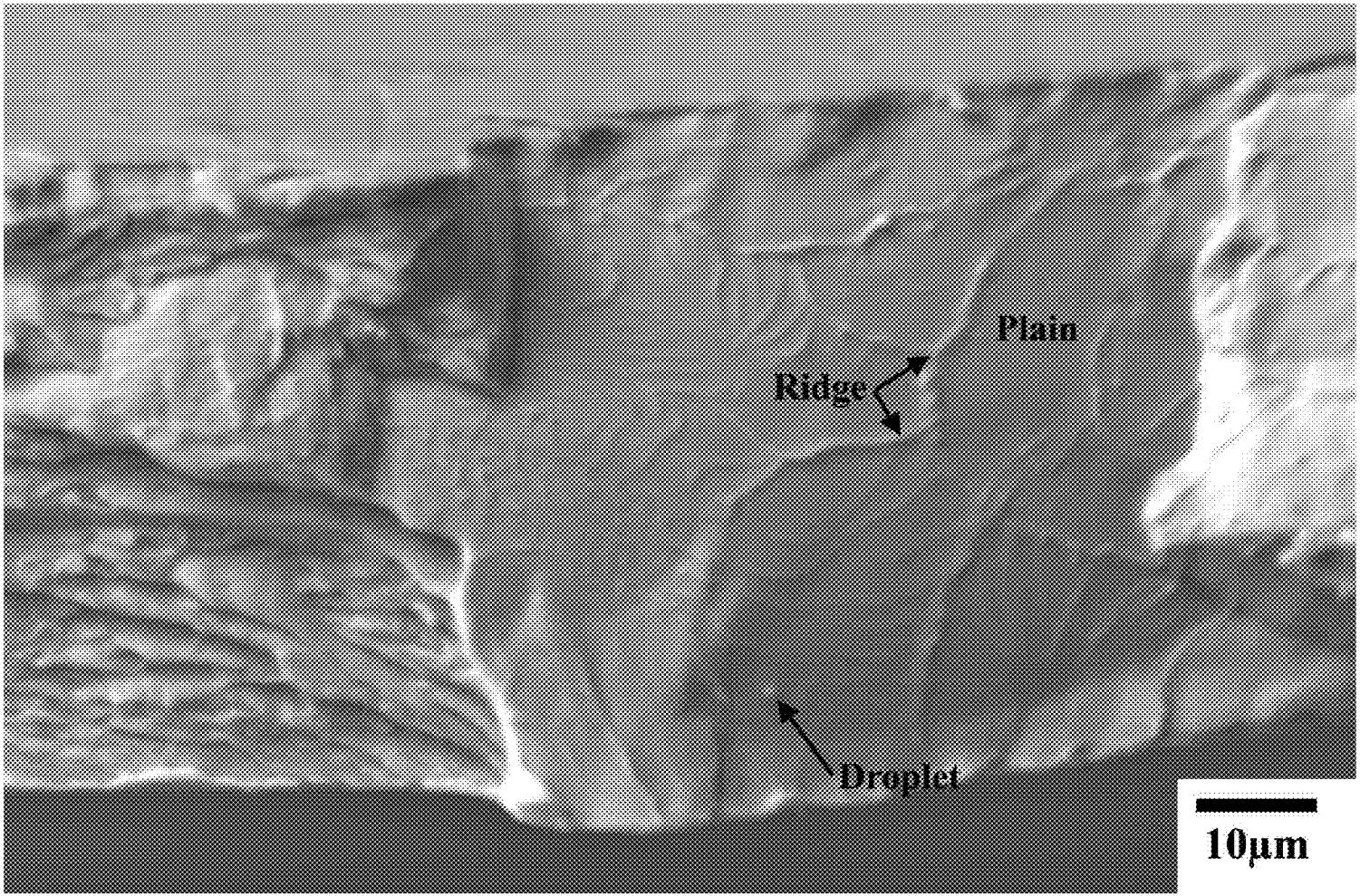
FIG. 16 illustrates an SEM secondary electron micrograph of the PC7E7w16 fracture surface.

The fracture surface of the PC7E7w16 ribbon sample was studied using secondary electrons in tensile tested samples. Note that this sample was tested before an initial height correction small offset was corrected in the tensile machine which means that the sample was not in a pure tension environment. The central region of the micrograph shown in FIG. 16 is a fracture surface where the melt spun ribbon ruptured due to the tensile forces applied along the ribbon. The fracture surface in FIG. 16 is of the complete cross section of the ribbon. On the fracture surface there is a network of ridges that are randomly distributed with a couple of ridges identified with arrows in the figure as examples. Generally, the ridges tend to be long and there are even sets of ridges that are parallel to one another suggesting that they may correspond to shear bands. In addition some of the ridges appear that they may be taller than others and still other ridges appear to be fainter. Since this is a fracture surface, any surface feature with height represents the last material to pull apart so it is supposed that these ridges are like dimple cell walls, which are commonly observed on the fracture surfaces of ductile materials.

Figure 17:
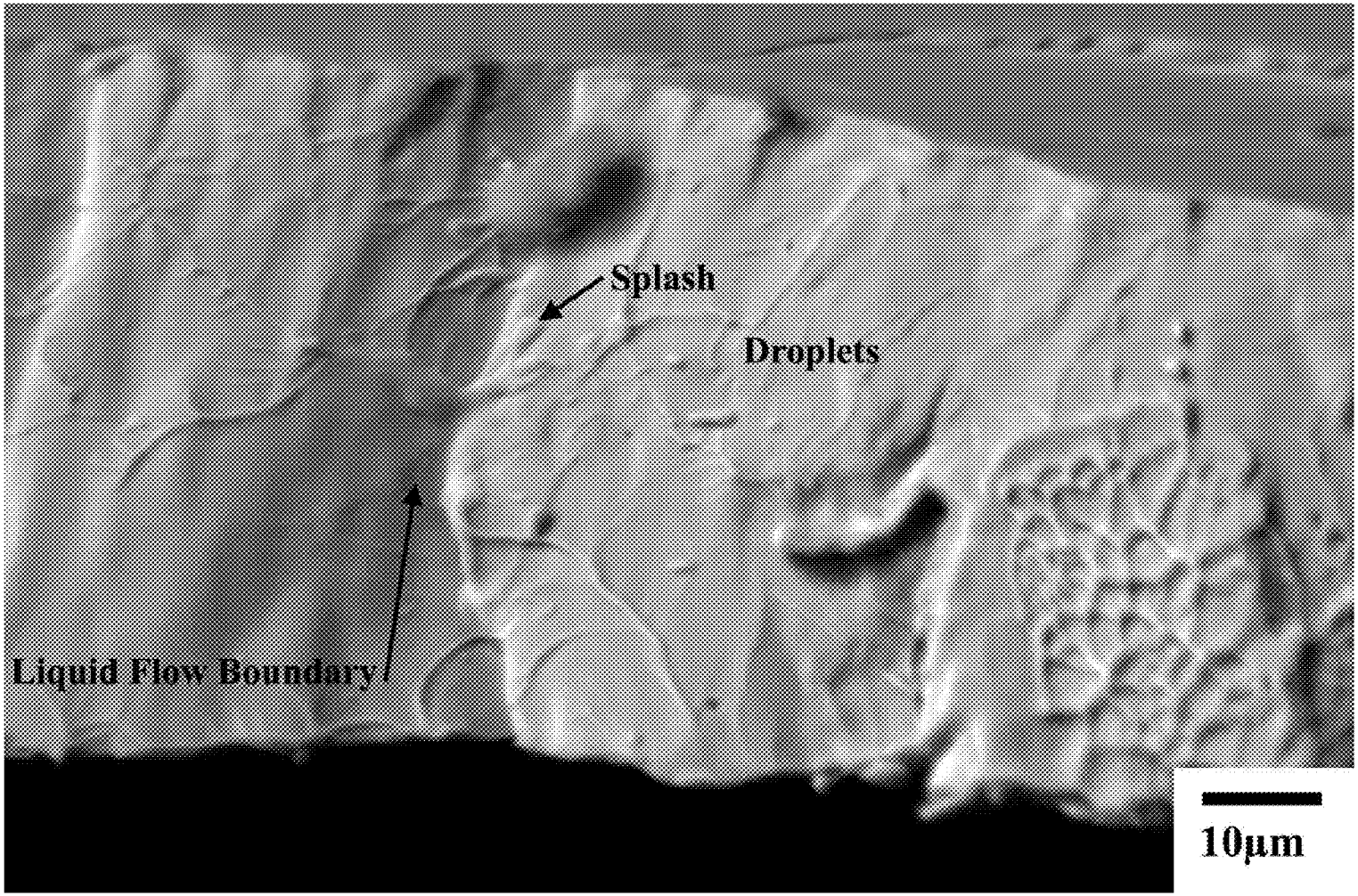
FIG. 17 illustrates an SEM secondary electron micrograph of the PC7E7w16 fracture surface.

The region in between the ridges, which is identified as a plain, appears to be very smooth and flat. It has been proposed hypothetically that the applied stress heats up localized regions such that the metal melts forming a liquid rupture occurs when a sufficient amount of cross sectional area has liquefied. Evidence for this is shown in FIG. 16 where a small spherical object attached to the surface and looks like a droplet. Additional evidence for droplets is shown in FIG. 17 where an additional feature is present identified as a splash in the Figure as it appears to be solidified metal that splashed onto the new fracture surface. Connected to this feature is what is labeled as the liquid flow boundary that looks like the limit of the fluid flow before solidification.

Figure 18:
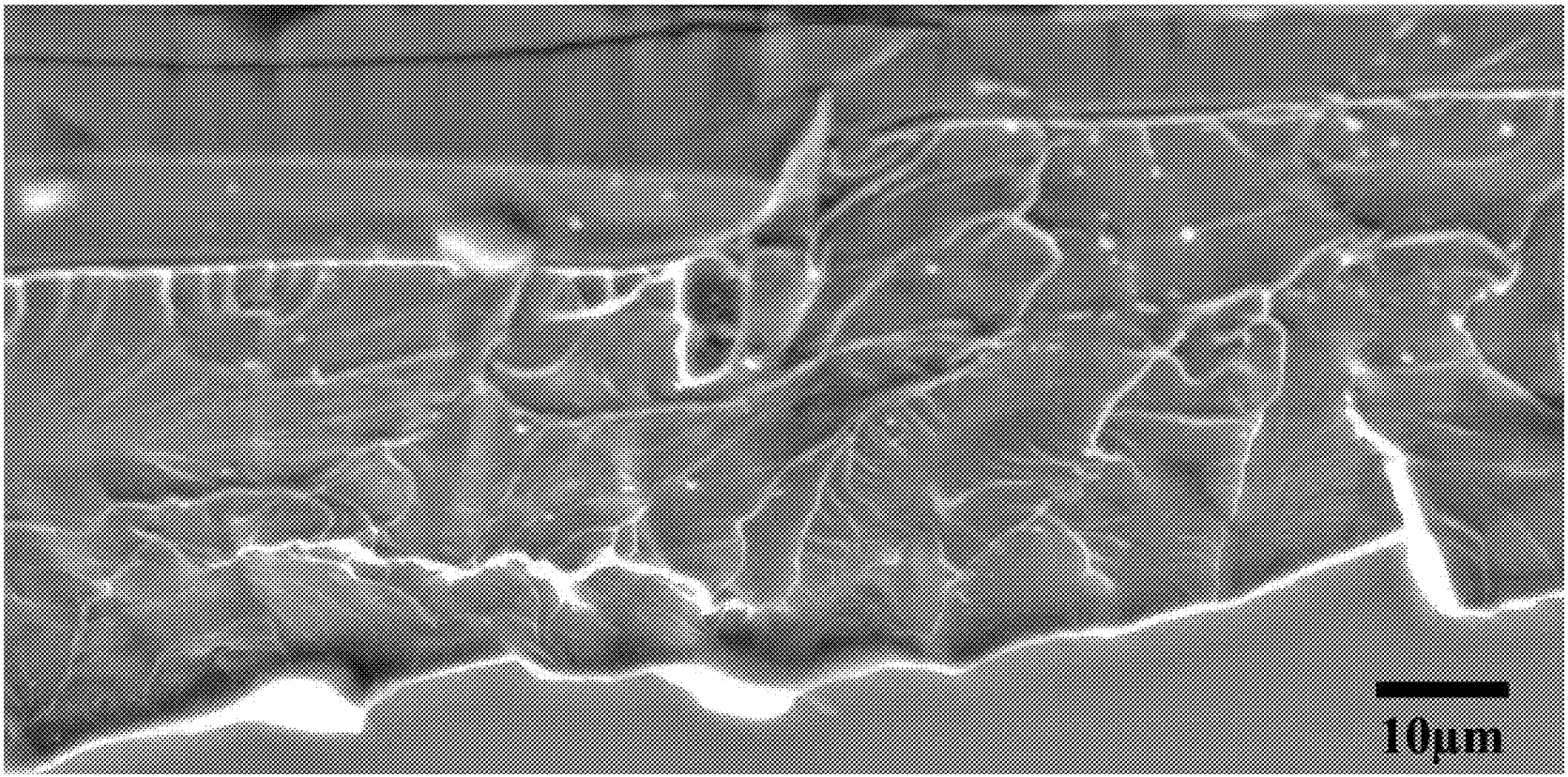
FIG. 18 illustrates an SEM secondary electron micrograph of the PC7E8S8A6w16 fracture surface.

The fracture surface of a PC7E8S8A6w16 tensile specimen is shown in FIG. 18. This sample was tested after the micro-tester had its alignment improved. The common fracture surface features of ridges, plains and droplets are clearly identifiable. This fracture surface is much longer than the one presented for PC7E7w16. There are numerous different features that are likely droplets scattered over the entire surface suggesting that the entire fracture surface at some point melted. In addition, there is clear evidence for a network of principle ridges, based on having a brighter contrast, to which other fainter ridges intersect at perpendicular angles. It appears likely that the fainter ridges are shear bands given their near parallel morphology but that their fainter contrast also suggests that they have been partially submerged by the molten liquid that splashed onto to surface when rupture occurred.

Case Example #6

Figure 19:
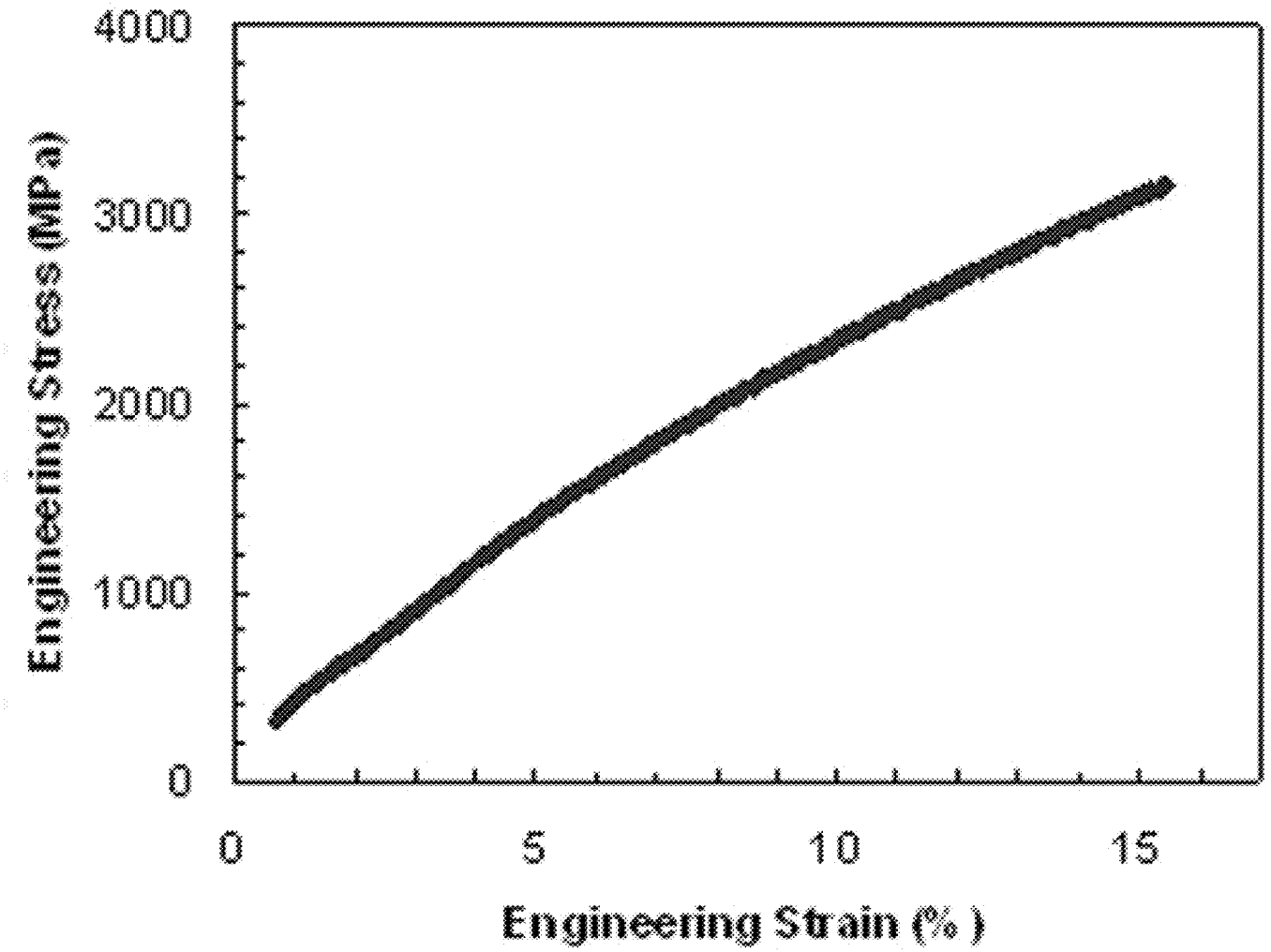
FIG. 19 illustrates a stress-strain curve of the PC7E8S1A9 ribbon, which was subsequently examined by scanning electron microscopy (SEM).

Using high purity elements, a 15 g alloy feedstock of the PC7E8S1A9 alloy was weighed out according to the atomic ratio's provided in Table 2. The feedstock material was then placed into the copper hearth of an arc-melting system. The feedstock was arc-melted into an ingot using high purity argon as a shielding gas. The ingot was flipped several times and remelted to ensure homogeneity. After mixing, the ingots were then cast in the form of a finger approximately 12 mm wide by 30 mm long and 8 mm thick. The resulting fingers were then placed in a melt-spinning chamber in a quartz crucible with a hole diameter of ~0.81 mm. The ingots were melted in a ⅓ atm helium atmosphere using RF induction and then ejected onto a 245 mm diameter copper wheel which was traveling at tangential velocities of 10.5 m/s. The as-cast ribbon is 1.20 mm wide and 0.07 mm thick. It was stretched to fracture, which occurred in the middle of the 2.30 mm gage length at a strength of 3.15 GPa, with significant elongation (See FIG. 19).

Figure 20:
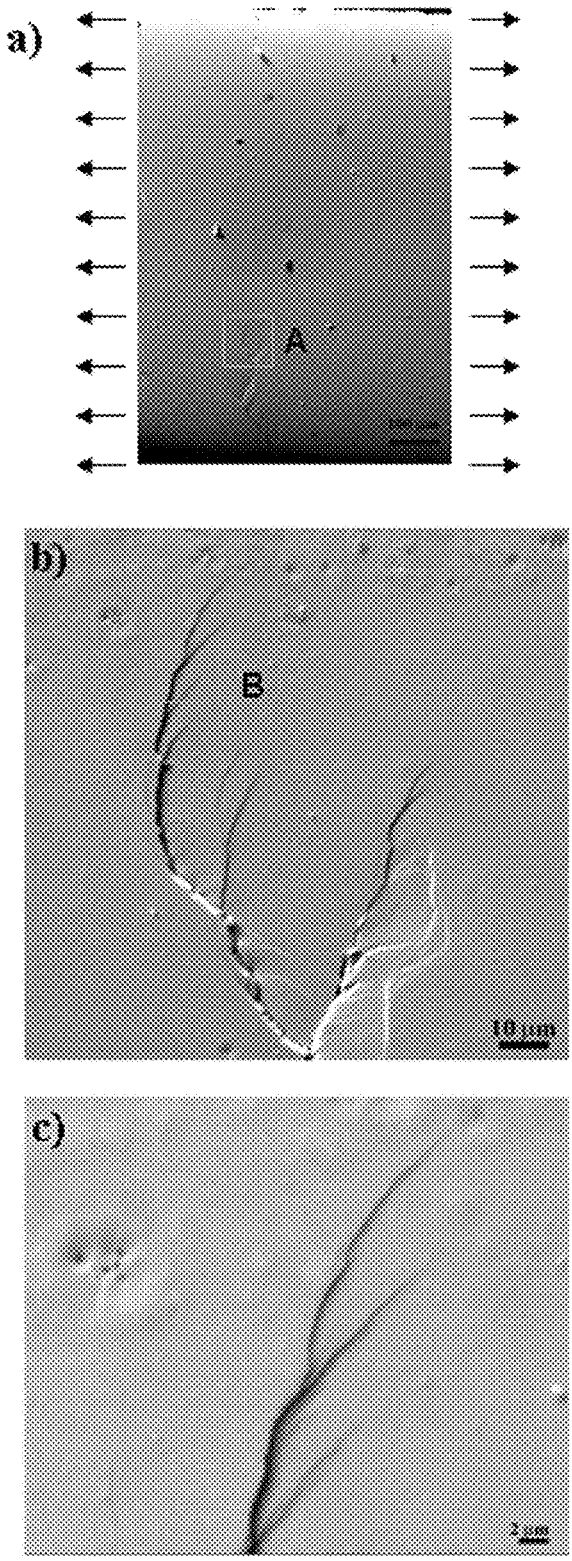
FIG. 20 illustrates SEM micrographs of arrested cracks under uniform tension loading.
Figure 21:
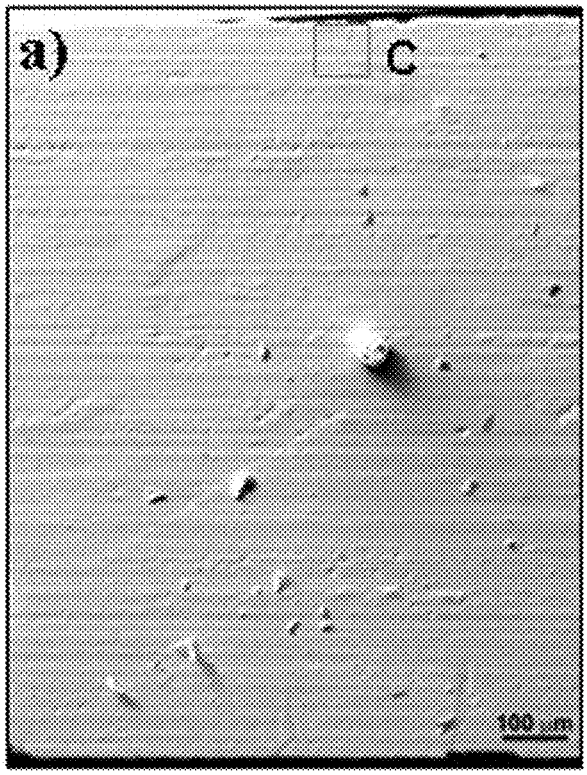
FIG. 21 illustrates SEM micrographs of underdeveloped edge cracks.
Figure 21:
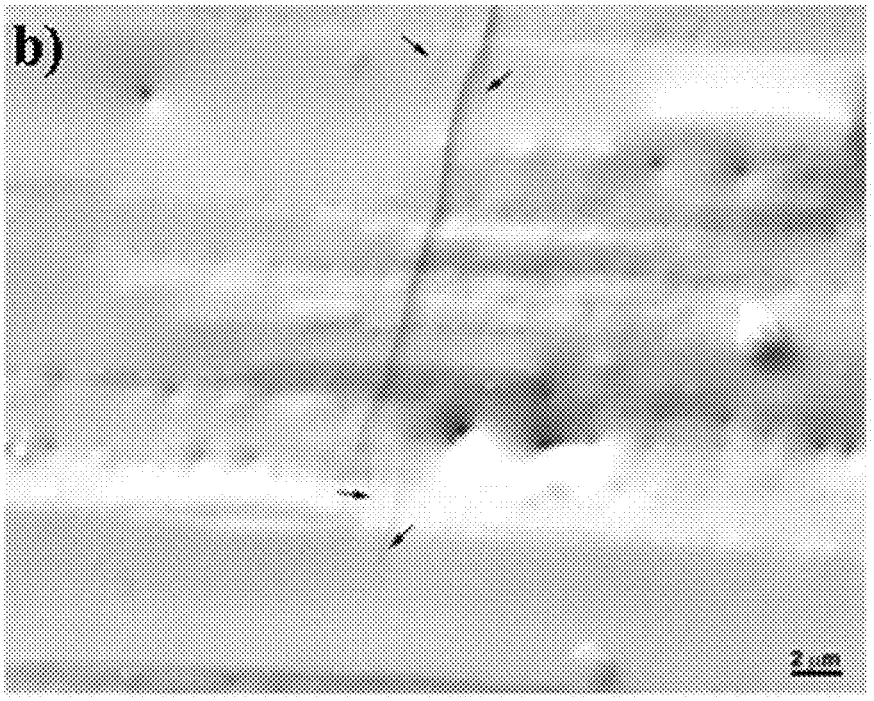

In the tensile deformed PC7E8S1A9 ribbon, several underdeveloped edge cracks were observed in the SEM. One is shown in FIG. 20*a*, in which the stretching direction was in the horizontal direction, as indicated by the multiple arrows. The multiple arrows indicate that the remote tensile stress may be uniform in the cross section of the ribbon. The details of the edge crack, within selected region A in FIG. 20*a*, are revealed at a high magnification in FIG. 20*b*. After nucleation and initial growth, the main crack was deflected in a continuous fashion to directions that have inclined angles with respect to the loading axis. Meanwhile, secondary cracks, or crack branches were formed which were subsequently arrested after a limited amount of propagation. This is further shown in FIG. 20*c*, which amplifies the selected region B in FIG. 20*b*. Such crack deflecting and branching occurs repeatedly at multiple microstructure levels from sub-micron to macro scale. Several other underdeveloped cracks were also observed in the stretched ribbon, but their images are not included here. It is believed that these cracks were arrested at different growing stages with different crack lengths. The crack deflecting and branching could occur at a very early growing stage right after the crack is initiated. FIG. 21 shows such an example, where these blunting processes occur for a crack that is only ~20 μm long.

It should be noted that crack branching actually involves microcracking and bridging that occurs simultaneously. As a result, growing of the main crack is hindered, since the energy required for growing is consumed by the formation of multiple cracks and the deformation occurred in a relatively large volume. Based on the fracture stress and the current crack profile, the fracture toughness of the crack is roughly estimated. It is in the range from ~125 $MPa \cdot m^{1/2}$ to ~200 $MPa \cdot m^{1/2}$, which is about two orders of magnitude higher than typical ceramics and glasses, and comparable to those of the toughest steels.

Case Example #7

Using high purity elements, 15 g alloy feedstocks of selected alloys from Table 3 including PC7E8S2A1, PC7E8S3A1, PC7E8S4A1, PC7E8S6A1 and PC7E8S7A2 alloys were weighed out according to the atomic ratio's provided in Table 3. The feedstock material was then placed into the copper hearth of an arc-melting system. The feedstock was arc-melted into an ingot using high purity argon as a shielding gas. The ingots were flipped several times and remelted to ensure homogeneity. After mixing, the ingots were then cast in the form of a finger approximately 12 mm wide by 30 mm long and 8 mm thick. The resulting fingers were then placed in a melt-spinning chamber in a quartz crucible with a hole diameter of ~0.81 mm. The ingots were processed under various process conditions as shown in Table 17.

TABLE 17

Process Parameter List

| MS | Chamber gas | Pressure in chamber [mbar] | Pressure in ballast [torr] | Wheel Speed [m/s] | Crucible-chill gap [mm] | Ejection Pressure [mbar] | Ejection Temp. [° C.] |
|---|---|---|---|---|---|---|---|
| 59 | He | 340 | 465 | 25 | 5 | 280 | 1250 |
| 70 | He | 340 | 360 | 35 | 5 | 280 | 1250 |
| 71 | He | 340 | 465 | 35 | 5 | 280 | 1350 |

Thermal analysis was performed on the as-solidified ribbons using a Perkin Elmer DTA-7 system with the DSC-7 option. Differential thermal analysis (DTA) and differential scanning calorimetry (DSC) was performed at a heating rate of 10° C./minute with samples protected from oxidation through the use of flowing ultrahigh purity argon. In Table 15, the DSC data related to the glass to crystalline transformation is shown for the alloys that have been melt-spun using the various melt-spinning process parameters. All of the samples were found to contain a significant fraction of glass. The glass to crystalline transformation occurs in two stages in the range of temperature from 397 to 525° C. and with enthalpies of transformation from −78.8 to −92.8 J/g.

TABLE 18

DTA Data

| Alloy | Melt Spinning Parameter | Glass Present | Peak #1 Onset [° C.] | Peak #1 Temp [° C.] | Peak #1 −ΔH [J/g] | Peak #2 Onset [° C.] | Peak #2 Temp [° C.] | Peak #2 −ΔH [J/g] |
|---|---|---|---|---|---|---|---|---|
| PC7E8S2A1 | MS70 | Yes | 426 | 438 | 38.1 | 501 | 506 | 54.8 |
| PC7E8S3A1 | MS71 | Yes | 414 | 426 | 29.4 | 480 | 485 | 53.1 |
| PC7E8S4A1 | MS59 | Yes | 397 | 408 | 34.5 | 464 | 470 | 55.1 |
| PC7E8S6A1 | MS59 | Yes | 410 | 420 | 28.8 | 477 | 482 | 55.8 |
| PC7E8S7A2 | MS71 | Yes | 448 | 460 | 40.2 | 515 | 524 | 38.6 |

The ability of the ribbons to bend completely flat may indicate a ductile condition whereby high strain can be obtained but not measured by traditional bend testing. When the ribbons are folded completely around themselves, they may experience high strain which can be as high as 119.8% as derived from complex mechanics. In practice, the strain may be in the range of ~57% to ~97% strain in the tension side of the ribbon. During 180° bending (i.e. flat), four types of behavior were observed; Type 1 Behavior—not bendable without breaking, Type 2 Behavior—bendable on one side with wheel side out, Type 3 Behavior—bendable on one side with free side out, and Type 4 Behavior—bendable on both sides. Reference to "wheel side" may be understood as the side of the ribbon which contacted the wheel during melting spinning. In Table 19, a summary of the 180° bending results including the specific behavior type are shown for the studied alloys and all are found to be Type 4. Note that previously as shown in Table 6, these alloys all exhibited Type 1 behavior with the exception of PC7E8S4A1 which exhibited Type 2 bending behavior. Thus, these results clearly show for the alloy chemistries listed in Table 2 and Table 3, that their chemistries are in atomic ranges which are possible to produce favorable SGMM structures. Whether or not the favorable structure is formed may therefore be dependant on processing parameters and the resulting mechanical behavior may range from a brittle to ductile response.

TABLE 19

Bend Testing Results

| Alloy | Melt-Spinning Parameter | Density [g/cm$^3$] | Thickness [μm] | Bend Ability Type |
|---|---|---|---|---|
| PC7E8S2A1 | MS70 | 7.711 | 28-39 | 4 |
| PC7E8S3A1 | MS71 | 7.824 | 24-37 | 4 |
| PC7E8S4A1 | MS59 | 7.913 | 31-37 | 4 |
| PC7E8S6A1 | MS59 | 7.674 | 32-38 | 4 |
| PC7E8S7A2 | MS71 | 7.853 | 22-30 | 4 |

In Table 20, a summary of the tensile test results including gage dimensions, elongation, breaking load, yield stress, ultimate strength and Young's Modulus are shown for each alloy of Table 13. Note that each distinct sample was measured in triplicate since occasional macrodefects arising from the melt-spinning process can lead to localized stresses reducing properties. As can be seen the total elongation values are significant and vary from 1.45 to 4.03% with high tensile strength values from 1.22 to 2.99 GPa. Young's Modulus was found to vary from 116.3 to 185.2 GPa. Note that the results shown in Table 20 have been adjusted for machine compliance and geometric cross sectional area. Note also that with the previous process parameter, PC7E8S2A1, PC7E8S3A1, PC7E8S6A1, AND PC7E8S7A2, were too brittle to test as indicated in Table 7. With further process parameter development, it is expected that most, if not all, of the alloys listed in Tables 2 and 3 could be processed into a ductile ribbon with tensile elongation greater than 1%.

TABLE 20

Tensile Property of Fibers

| Alloy | Gage Dimensions (mm) W | T | l | Elongation (%) | Break Load (N) | Strength (GPa) Yield | UTS | Young's Modulus (GPa) |
|---|---|---|---|---|---|---|---|---|
| PC7E8S2A1 | 1.390 | 0.038 | 9.00 | 3.29 | 100.1 | 1.07 | 2.05 | 138.5 |
| | 1.391 | 0.034 | 9.00 | 3.19 | 120.9 | 1.51 | 2.78 | 158.1 |
| | 1.378 | 0.036 | 9.00 | 2.49 | 83.1 | 0.80 | 1.81 | 153.6 |
| PC7E8S3A1 | 1.494 | 0.036 | 9.00 | 3.06 | 123.6 | 1.33 | 2.48 | 153.1 |
| | 1.532 | 0.033 | 9.00 | 3.53 | 133.2 | 1.35 | 2.84 | 155.8 |
| | 1.582 | 0.034 | 9.00 | 2.77 | 90.7 | 0.97 | 1.83 | 143.4 |
| PC7E8S4A1 | 1.502 | 0.036 | 9.00 | 4.03 | 111.5 | 1.60 | 2.99 | 185.2 |
| | 1.571 | 0.036 | 9.00 | 3.76 | 113.9 | 0.93 | 2.17 | 176.3 |
| | 1.541 | 0.035 | 9.00 | 1.98 | 50.4 | 0.78 | 0.98 | 168.6 |
| PC7E8S6A1 | 1.536 | 0.036 | 9.00 | 3.10 | 144.3 | 1.56 | 2.82 | 185.2 |
| | 1.616 | 0.036 | 9.00 | 2.03 | 84.3 | 1.07 | 1.65 | 152.2 |
| | 1.620 | 0.034 | 9.00 | 2.64 | 115.7 | 1.24 | 2.27 | 178.4 |
| PC7E8S7A2 | 1.283 | 0.024 | 9.00 | 2.97 | 74.0 | 1.56 | 2.59 | 157.7 |
| | 1.160 | 0.025 | 9.00 | 1.45 | 32.8 | 1.18 | 1.22 | 157.2 |
| | 1.202 | 0.027 | 9.00 | 3.11 | 59.7 | 1.04 | 1.99 | 116.3 |

The foregoing description of several methods and embodiments has been presented for purposes of illustration. It is not intended to be exhaustive or to limit the claims to the precise steps and/or forms disclosed, and obviously many modifications and variations are possible in light of the above teaching. It is intended that the scope of the invention be defined by the claims appended hereto.

What is claimed is:

1. A method of forming spinodal microconstituents in a glass forming alloy comprising:

melting alloy constituents consisting of 43.0 atomic percent to 68.0 atomic percent iron, 10.0 atomic percent to 19.0 atomic percent boron, 13.0 atomic percent to 17.0 atomic percent nickel, 2.5 atomic percent to 21.0 atomic percent cobalt, optionally one or more of the following 0.1 atomic percent to 6.0 atomic percent carbon, 0.3 atomic percent to 3.5 atomic percent silicon, 1 atomic percent to 8 atomic percent titanium, 1 atomic percent to 8 atomic percent molybdenum, 1 atomic percent to 8 atomic percent copper, 1 atomic percent to 8 atomic percent cerium, and 2 atomic percent to 16 atomic percent aluminum to form an alloy having a critical cooling rate for metallic glass formation of <100,000 K/s; and forming and cooling said alloy, at a rate of $10^2$ K/s to $10^6$ K/s wherein upon cooling the glass forming alloy includes between 5% to 95% by volume spinodal microconstituents comprising one or more semi-crystalline or crystalline phases at a length scale less than 50 nm in a glass matrix effectively blunting shear bands through localized deformation induced changes under tension and wherein said alloy exhibits a tensile elongation of greater than 1% and up to 7%.

2. The method of claim 1, wherein said alloy constituents consist of 43.0 atomic percent to 68.0 atomic percent iron, 12.0 atomic percent to 19.0 atomic percent boron, 15.0 atomic percent to 17.0 atomic percent nickel, 2.5 atomic percent to 21.0 atomic percent cobalt, optionally 0.1 atomic percent to 6.0 atomic percent carbon, and optionally 0.4 atomic percent to 3.5 atomic percent silicon.

3. The method of claim 1, wherein said alloy constituents consist of 52.0 atomic percent to 63.0 atomic percent iron, 10.0 atomic percent to 13.0 atomic percent boron, 13.0 atomic percent to 17.0 atomic percent nickel, 2.5 atomic percent to 3.0 atomic percent cobalt, 0.1 atomic percent to 5.0 atomic percent carbon, 0.3 atomic percent to 0.5 atomic percent silicon, and one or more of the following: 1 atomic percent to 8 atomic percent titanium, 1 atomic percent to 8 atomic percent molybdenum, 1 atomic percent to 8 atomic percent copper, 1 atomic percent to 8 atomic percent cerium, and 2 atomic percent to 16 atomic percent aluminum.

4. The method of claim 1 wherein said alloy exhibits a thickness of 2000 μm or less.

5. The method of claim 1 wherein said alloy exhibits a thickness of 250 μm or less.

6. The method of claim 1 wherein said alloy is formed into sheet, foil, ribbon, fiber, powder, or wire upon cooling.

7. The method of claim 1 wherein said alloy is at least formed and cooled in a process including the Taylor-Ulitovsky wire making process, chill block melt-spinning process, planar flow casting process, and twin roll casting.

* * * * *